US011384509B2

(12) United States Patent
Nakano et al.

(10) Patent No.: US 11,384,509 B2
(45) Date of Patent: Jul. 12, 2022

(54) WORK MACHINE

(71) Applicant: HITACHI CONSTRUCTION MACHINERY CO., LTD., Tokyo (JP)

(72) Inventors: Hisami Nakano, Tsuchiura (JP); Hiroaki Tanaka, Kasumigaura (JP); Yusuke Suzuki, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 491 days.

(21) Appl. No.: 16/492,363

(22) PCT Filed: Mar. 22, 2018

(86) PCT No.: PCT/JP2018/011513
§ 371 (c)(1),
(2) Date: Sep. 9, 2019

(87) PCT Pub. No.: WO2019/180894
PCT Pub. Date: Sep. 26, 2019

(65) Prior Publication Data

US 2020/0232186 A1 Jul. 23, 2020

(51) Int. Cl.
*E02F 9/22* (2006.01)
*E02F 3/43* (2006.01)

(52) U.S. Cl.
CPC ..... *E02F 9/2203* (2013.01); *E02F 3/435* (2013.01); *E02F 9/2271* (2013.01)

(58) Field of Classification Search
CPC ..... E02F 3/435; E02F 9/2203; E02F 3/437; E02F 9/2271; F15B 21/087
See application file for complete search history.

(56) References Cited

U.S. PATENT DOCUMENTS 5,701,691 A * 12/1997 Watanabe ..... E02F 3/435 701/50
5,835,874 A * 11/1998 Hirata ..... E02F 3/435 60/426

(Continued)

FOREIGN PATENT DOCUMENTS

JP 03-080310 A 4/1991
JP 05-321297 A 12/1993

(Continued)

OTHER PUBLICATIONS

International Preliminary Report on Patentability received in corresponding International Application No. PCT/JP2018/011513 dated Oct. 1, 2020.

(Continued)

*Primary Examiner* — Abiy Teka
(74) *Attorney, Agent, or Firm* — Mattingly & Malur, PC

(57) ABSTRACT

A controller (25) of the hydraulic excavator (1) includes a signal separation section (150) that separates each of target speed signals for a plurality of front members (8, 9, 10) into a low frequency component and a high frequency component, a high fluctuation target speed calculation section (143) that allocates the separated high frequency components preferentially to a front member having a relatively small inertial load to calculate high fluctuation target speeds individually for the plurality of front members, a high fluctuation target actuator speed calculation section (141*c*) that calculates high fluctuation target speeds individually for the plurality of actuators from the high fluctuation target speeds for the plurality of front members, a low fluctuation target actuator speed calculation section (141*b*) that calculates low fluctuation target speeds individually for the plurality of actuators from the low frequency components separated by the signal separation section, and an actuator controller (200) that controls the plurality of actuators (Continued)

individually based on values obtained by adding the high fluctuation target speeds and the low fluctuation target speeds.

6 Claims, 17 Drawing Sheets

(56) References Cited

U.S. PATENT DOCUMENTS

| | | | | |
|---|---|---|---|---|
| 2016/0215475 | A1* | 7/2016 | Meguriya | E02F 9/2285 |
| 2016/0273186 | A1* | 9/2016 | Kami | E02F 9/2296 |
| 2019/0078290 | A1* | 3/2019 | Yamada | E02F 9/2004 |

FOREIGN PATENT DOCUMENTS

| | | | |
|---|---|---|---|
| JP | 2011-224694 | A | 11/2011 |
| JP | 2012-172382 | A | 9/2012 |
| WO | 2012/127912 | A1 | 9/2012 |
| WO | 2015/181990 | A1 | 12/2015 |

OTHER PUBLICATIONS

International Search Report of PCT/JP2018/011513 dated Jun. 12, 2018.

* cited by examiner

VECTOR V0 BEFORE CORRECTION BASED ON DISTANCE D

VECTOR V1 AFTER CORRECTION BASED ON DISTANCE D

WORK MACHINE

TECHNICAL FIELD

The present invention relates to a work machine such as a hydraulic excavator.

BACKGROUND ART

As a technology for improving the work efficiency of a work machine (for example, a hydraulic excavator) that includes a work implement such as, for example, a front work implement driven by a hydraulic actuator, a machine control (MC) is available. The MC is a technology for performing, in the case where an operation device is operated by an operator, operation support for the operator by executing semiautomatic control of controlling a work implement to act in accordance with a condition determined in advance.

As the MC for a hydraulic excavator that is one form of a work machine, semiautomatic excavation shaping control is known which controls a front work implement such that a control point of the front work implement (a bucket toe) is prevented from entering a target surface also called design surface (Such semiautomatic excavation shaping control is sometimes called "area limiting control" in the sense of control of limiting the area of movement of the front work implement to an area above a target surface). For example, in a work machine control system of Patent Document 1, in the case where an operation signal outputted in response to an operation of a front work implement by an operator includes an arm operation signal, it is decided that it is tried to perform a shaping work in which the bucket is moved along the target surface. Then, the boom is automatically caused to act such that the speed of the distal end of the bucket that appears in a direction perpendicular to the target surface is cancelled by an arm action thereby to implement a work for moving the bucket semiautomatically along the target surface. The speed of the distal end of the bucket described above is hereinafter referred to as perpendicular speed.

The work described above makes it possible, in a leveling work of moving the bucket along the target surface, to excavate and shape the target surface only if the operator operates the arm. Further, since the operator can adjust the bucket distal end speed (which is hereinafter referred to as excavation speed), caused in a parallel direction to the target surface by the operation amount of the arm, the operator can perform the leveling operation at an intended speed. This is because, since the excavation speed by an arm action has a tendency that it is higher than the perpendicular speed and the excavation speed by a boom action has a tendency that it is lower than the perpendicular speed, the excavation speed fluctuates mainly in accordance with the arm action speed.

PRIOR ART DOCUMENT

Patent Document

Patent Document 1: PCT Patent Publication No. WO 2012/127912

SUMMARY OF THE INVENTION

Problems to be Solved by the Invention

However, according to a work machine that uses the work implement control system disclosed in Patent Document 1, depending on the excavation speed, it is difficult to move the bucket stably along the target surface, resulting in the possibility that the shaping accuracy of the target surface may be lost. In the case where a leveling work is performed utilizing the semiautomatic excavation shaping control, the arm performs a crowding action (leveling action) in accordance with the operation of the operator and the boom automatically performs a raising action such that the perpendicular speed caused by the arm action is cancelled. If the bucket distal end enters below the target surface by an influence of disturbance such as the soil quality, then the boom raising speed increases such that the bucket tip does not enter the target surface any more. If the bucket distal end thereafter reaches the target surface, then the boom raising speed is suppressed and tends to hold the bucket distal end on the target surface.

However, at this time, if the excavation speed is somewhat high, then the increase of the boom raising speed may not be made in time, resulting in the possibility that the bucket distal end may move over a long distance in the horizontal direction while it remains positioned below the target surface. Alternatively, suppression of the boom raising speed when the bucket distal end reaches the target surface may not be made in time, resulting in the possibility that the bucket distal end may lift up from the target surface. In other words, if the arm action is performed at a high speed, then it is difficult to perform stable semiautomatic excavation shaping control, resulting in the possibility that the excavation shaping accuracy may be lost. This occurs because the inertial load of the boom is higher than that of the arm and the delay of an actual speed change of the boom cylinder with respect to a speed change thereof required by the control system is large.

The present invention has been made in view of such a subject as described above and contemplates provision of a work machine that can perform semiautomatic excavation shaping control with higher accuracy even where the excavation speed is high.

Means for Solving the Problems

In order to achieve the object described above, according to the present invention, there is provided a work machine including a work implement having a plurality of front members, a plurality of hydraulic actuators configured to drive the plurality of front members, an operation device configured to instruct an action for each of the plurality of hydraulic actuators in response to an operation by an operator, and a controller including a target speed calculation section configured to calculate target speeds individually for the plurality of front members such that, when the operation device is operated, the work implement is limited so as to be positioned above a predetermined target surface, in which the controller includes a signal separation section configured to separate each of signals of the target speeds for the plurality of front members into a low frequency component having a frequency lower than a predetermined threshold value and a high frequency component having a frequency higher than the threshold value, a high fluctuation target speed calculation section configured to allocate the high frequency component separated by the signal separation section preferentially to one of the front members, the one front member having a relatively small inertial load, from among the plurality of front members to calculate high fluctuation target speeds individually for the plurality of front members, a high fluctuation target actuator speed calculation section configured to calculate the high fluctuation target speeds individually for the plurality of actuators, based on the high fluctuation target speeds for the plurality of front members calculated by the high fluctuation target speed calculation section and posture data of the plurality of front members, a low fluctuation target actuator speed calculation section configured to calculate low fluctuation target speeds individually for the plurality of actuators, based on the low frequency component separated by the signal separation section and the posture data of the plurality of front members, and an actuator controller configured to control the plurality of actuators individually, based on values obtained by adding results of the calculation of the high fluctuation target actuator speed calculation section and results of the calculation of the low fluctuation target actuator speed calculation section individually for the plurality of actuators.

Advantage of the Invention

According to the present invention, even in the case where the excavation speed is high, semiautomatic excavation shaping control can be performed with high accuracy.

MODES FOR CARRYING OUT THE INVENTION

Figure 1:
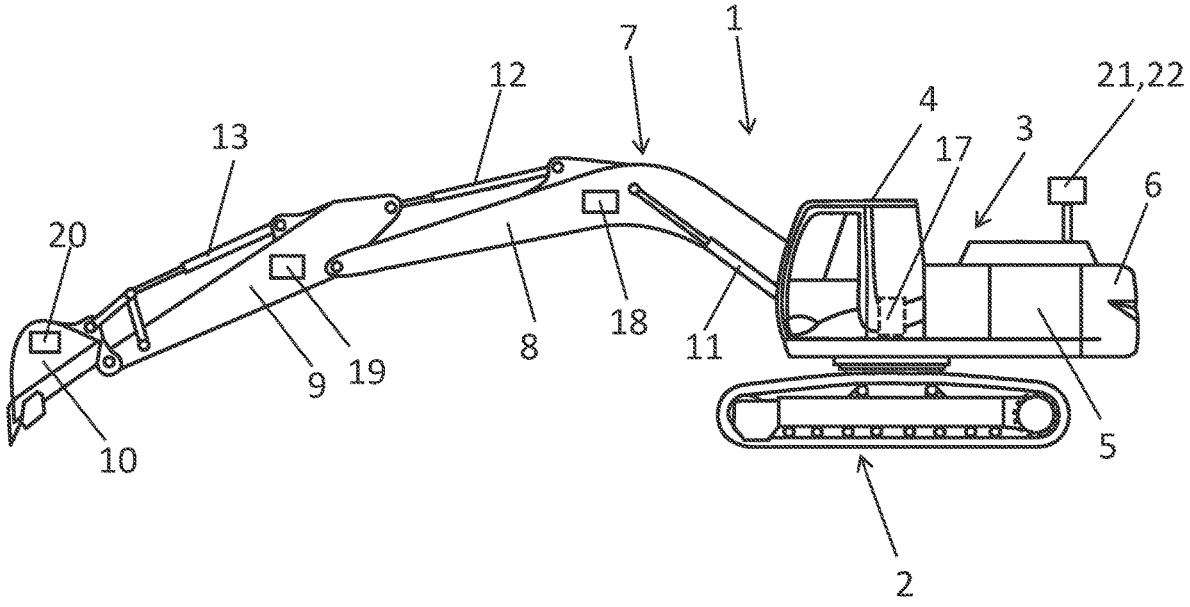
FIG. 1 is a side elevational view of a hydraulic excavator 1 that is an example of a work machine according to an embodiment of the present invention.

In the following, work machines according to embodiments of the present invention are described with reference to the drawings. Although a hydraulic excavator including a bucket 10 as a work tool (attachment) at the distal end of a work implement is exemplified in the following description, the present invention may be applied to a work machine that includes an attachment other than the bucket. The present invention can be applied also to a work machine other than a hydraulic excavator if the work machine has a work implement of an articulated type configured from a plurality of front members (which are an attachment, an arm, a boom and so forth), connected to each other.

Further, in regard to the meaning of such terms as "on", "above" and "below" that are used herein together with a term that represents a certain shape (for example, a target surface, a design surface or the like), "on" signifies the "surface of the certain shape"; "above" signifies a "position higher than the surface" of the certain shape; and "below" signifies a "position lower than the surface" of the certain shape. Further, in the following description, in the case where a plurality of same components exist, although an alphabetical character is sometimes added to the tail end of a reference character (numeral), the plurality of components are sometimes represented collectively with such alphabetical characters omitted. For example, where two pumps 2*a* and 2*b* exist, they are sometimes represented collectively as pumps 2.

First Embodiment

FIG. 1 is a side elevational view of a hydraulic excavator 1 that is an example of a work machine according to the embodiment of the present invention. The hydraulic excavator 1 includes a track structure (lower track structure 2) that travels by driving a crawler belt provided on each of left and right sides by a hydraulic motor (not depicted), and a swing structure (upper swing structure 3) provided for swing motion on the track structure 2.

The swing structure 3 includes an operation room 4, a machine room 5 and a counterweight 6. The operation room 4 is provided at a left side portion of a front portion of the swing structure 3. The machine room 5 is provided behind the operation room 4. The counterweight is provided behind the machine room 5, namely, at a rear end of the swing structure 3.

The swing structure 3 further includes a work implement (front work implement 7) of the articulated type. The work implement 7 is provided on the right side of the operation room 4 at a front portion of the swing structure 3, namely, at a substantially central portion of a front portion of the swing structure 3. The work implement 7 includes a boom 8, an arm 9, a bucket (work tool) 10, a boom cylinder 11, an arm cylinder 12 and a bucket cylinder 13. The boom 8 is attached at a proximal end portion thereof for pivotal motion to a front portion of the swing structure 3 through a boom pin P1 (depicted in FIG. 2). The arm 9 is attached at a proximal end portion thereof to a distal end portion of the boom 8 for pivotal motion through an arm pin P2 (depicted in FIG. 2). The bucket 10 is attached at a proximal end portion thereof to a distal end portion of the arm 9 for pivotal motion through a bucket pin P3 (depicted in FIG. 2). The boom cylinder 11, arm cylinder 12 and bucket cylinder 13 are hydraulic cylinders individually driven by hydraulic working fluid. The boom cylinder 11 expands and contracts to drive the boom 8; the arm cylinder 12 expands and contracts to drive the arm 9; and the bucket cylinder 13 expands and contracts to drive the bucket 10. It is to be noted that, in the following description, each of the boom 8, arm 9 and bucket (work tool) 10 is sometimes referred to as front member.

Installed in the inside of the machine room 5 are a first hydraulic pump 14 and a second hydraulic pump 15 of the variable displacement type (depicted in FIG. 3) and an engine (prime mover) 16 (depicted in FIG. 3) for driving the first hydraulic pump 14 and the second hydraulic pump 15.

A machine body tilt sensor 17 is attached in the inside of the operation room 4; a boom tilt sensor 18 is attached to the boom 8; an arm tilt sensor 19 is attached to the arm 9; and a bucket tilt sensor 20 is attached to the bucket 10. For example, the machine body tilt sensor 17, boom tilt sensor 18, arm tilt sensor 19 and bucket tilt sensor 20 are IMUs (Inertial Measurement Units): inertial measurement devices. The machine body tilt sensor 17 measures an angle (ground angle) of the swing structure (machine body) 3 with respect to a horizontal plane; the boom tilt sensor 18 measures the ground angle of the boom; the arm tilt sensor 19 measures the ground angle of the arm 9; and the bucket tilt sensor 20 measures the ground angle of the bucket 10.

Figure 2:
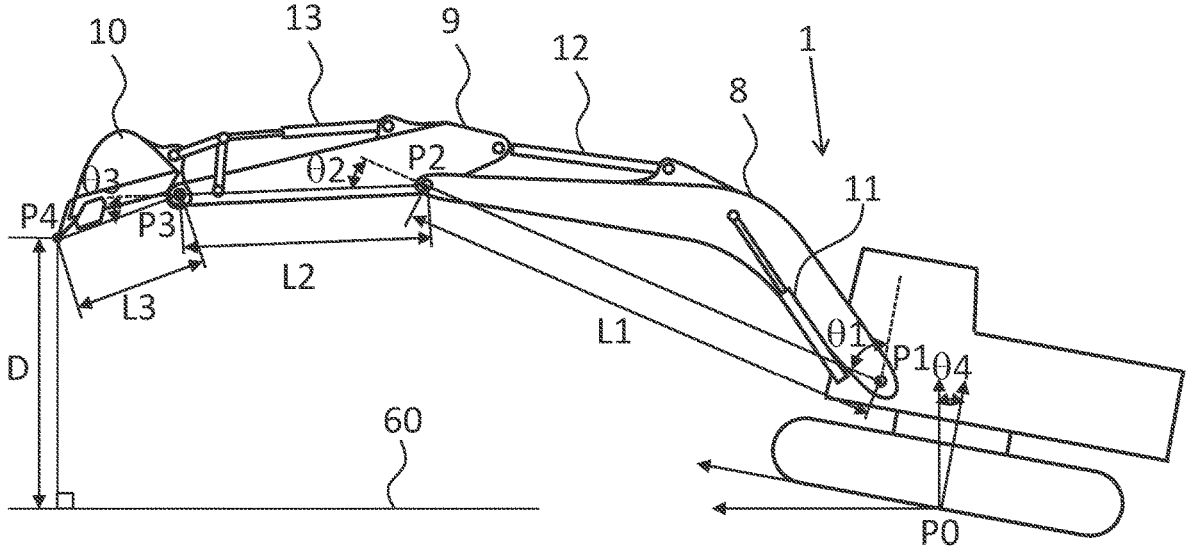
FIG. 2 is a side elevational view of the hydraulic excavator 1 in a global coordinate system and a local coordinate system.

A first GNSS antenna 21 and a second GNSS antenna 22 are attached to left and right portions of a rear portion of the swing structure 3, respectively. The GNSS is an abbreviation of Global Navigation Satellite System. Each of the first GNSS antenna 21 and the second GNSS antenna 22 can calculate position data of predetermined two points (for example, positions of the proximal ends of the GNSS antennae 21 and 22), in a global coordinate system from navigation signals received from a plurality of navigation satellites (preferably from four or more navigation satellites). Then, from the calculated position data (coordinate values), of the two points in the global coordinate system, coordinate values of the origin P0 (depicted in FIG. 2) of a local coordinate system in which the hydraulic excavator 1 is installed, namely, in a machine body reference coordinate system, and postures of the three axes configuring the local coordinate system in the global coordinate system can be calculated. In the example of FIG. 2, the postures of the three axes are postures and orientations of the track structure 2 and the swing structure 3. A calculation process of various positions based on such navigation signals can be performed by a controller 25 hereinafter described.

FIG. 2 is a side elevational view of the hydraulic excavator 1. As depicted in FIG. 2, the length of the boom 8, namely, the length from the boom pin P1 to the arm pin P2, is represented by L1. Meanwhile, the length of the arm 9, namely, the length from the arm pin P2 to the bucket pin P3, is represented by L2. Further, the length of the bucket 10, namely, the length from the bucket pin P3 to a bucket distal end P4 (a toe of the bucket 10), is represented by L3. Further, the inclination of the swing structure 3 with respect to the global coordinate system, namely, the angle defined by the vertical direction to the horizontal plane (the direction perpendicular to the horizontal plane), and the machine body vertical direction (the direction of the center axis of swing motion of the swing structure 3), is represented by θ4. The angle just described is hereinafter referred to as machine body front-back tilt angle θ4. The angle defined by a line segment interconnecting the boom pin P1 and the arm pin P2 and the machine body vertical direction is represented by θ1, and the angle is hereinafter referred to as boom angle θ1. The angle defined by a line segment interconnecting the arm pin P2 and the bucket pin P3 and a straight line including the boom pin P1 and the arm pin P2 is represented by θ2, and the angle is hereinafter referred to as arm angle θ2. The angle defined by a line segment interconnecting the bucket pin P3 and the bucket distal end P4 and a straight line interconnecting the arm pin P2 and the bucket pin P3 is represented by θ3, and the angle is hereinafter referred to as bucket angle θ3.

Figure 3:
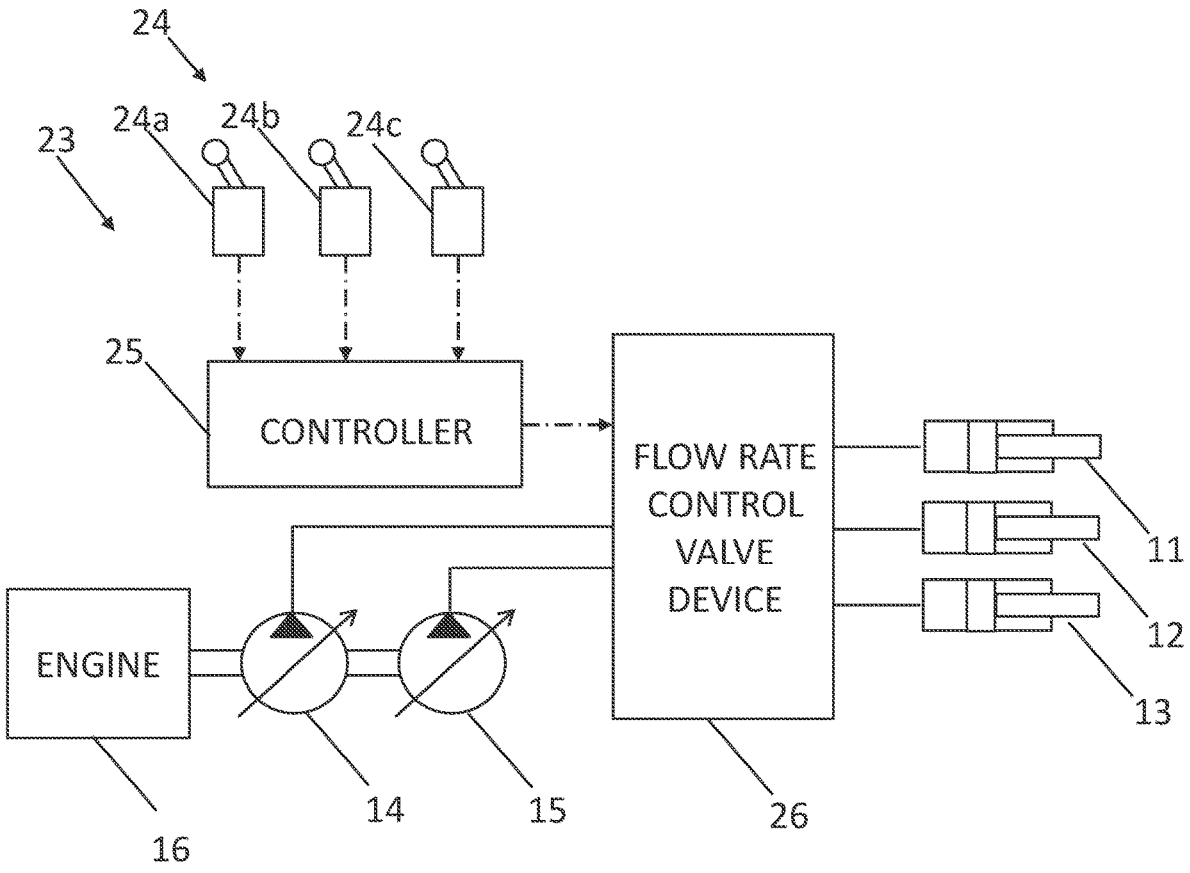
FIG. 3 is a block diagram of a machine body control system 23 of the hydraulic excavator 1.

FIG. 3 is a block diagram of the machine body control system 23 of the hydraulic excavator 1. The machine body control system 23 includes an operation device 24 for operating the work implement 7, an engine 16 for driving the first and second hydraulic pumps 14 and 15, a flow control valve device 26 for controlling the flow rate and the direction of hydraulic working fluid to be supplied from the first and second hydraulic pumps 14 and 15 to the boom cylinder 11, arm cylinder 12 and bucket cylinder 13, and a controller 25 that is a controller for controlling the flow control valve device 26.

The operation device 24 includes a boom operation lever 24*a* for operating the boom 8 (boom cylinder 11), an arm operation lever 24*b* for operating the arm 9 (arm cylinder 12), and a bucket operation lever 24*c* for operating the bucket 10 (bucket cylinder 13). For example, each of the operation levers 24*a*, 24*b* and 24*c* is an electric lever and outputs a voltage value according to a tilt angle (operation amount) and a tilt direction (operation direction) of the lever to the controller 25. The boom operation lever 24*a* outputs a target action amount for the boom cylinder 11 as a voltage value according to the operation amount of the boom operation lever 24*a* (which is hereinafter referred to as boom operation amount). The arm operation lever 24*b* outputs a target action amount for the arm cylinder 12 as a voltage value according to the operation amount of the arm operation lever 24*b* (which is hereinafter referred to as arm operation amount). The bucket operation lever 24*c* outputs a target action amount for the bucket cylinder 13 as a voltage value according to the bucket operation lever 24*c* (which is hereinafter referred to as bucket operation amount). As an alternative, each of the operation levers 24*a*, 24*b* and 24*c* may be formed as a hydraulic pilot lever such that a pilot pressure generated in response to a tilt amount of the lever is converted into a voltage value by a pressure sensor (not depicted) and outputted to the controller 25 to detect the operation amount of the lever.

The controller 25 calculates a control command on the basis of an operation amount outputted from the operation device 24, position data of the bucket distal end P4 that is a predetermined control point set in advance to the work implement 7 (control point position data), and position data of the target surface 60 (depicted in FIG. 2) (target surface data), stored in advance in the controller 25, and outputs the control command to the flow control valve device 26. The controller 25 in the present embodiment calculates the target speeds for the hydraulic cylinders 11, 12 and 13 in response to the distance D between the bucket distal end P4 that is the control point and the target surface 60, namely, to the target surface distance D (depicted in FIG. 2), such that, at the time of operation of the operation device 24, the range of action of the work implement 7 is limited to a position on or above the target surface 60. It is to be noted that, although the bucket distal end P4 (the control point of the bucket 10), is set as the control point of the work implement 7 in the present embodiment, an arbitrary point on the work implement 7 can be set as the control point, and, for example, a point on the work implement 7 nearest to the target surface 60 at the distal end side with respect to the arm 9 may be set as the control point.

Figure 4:
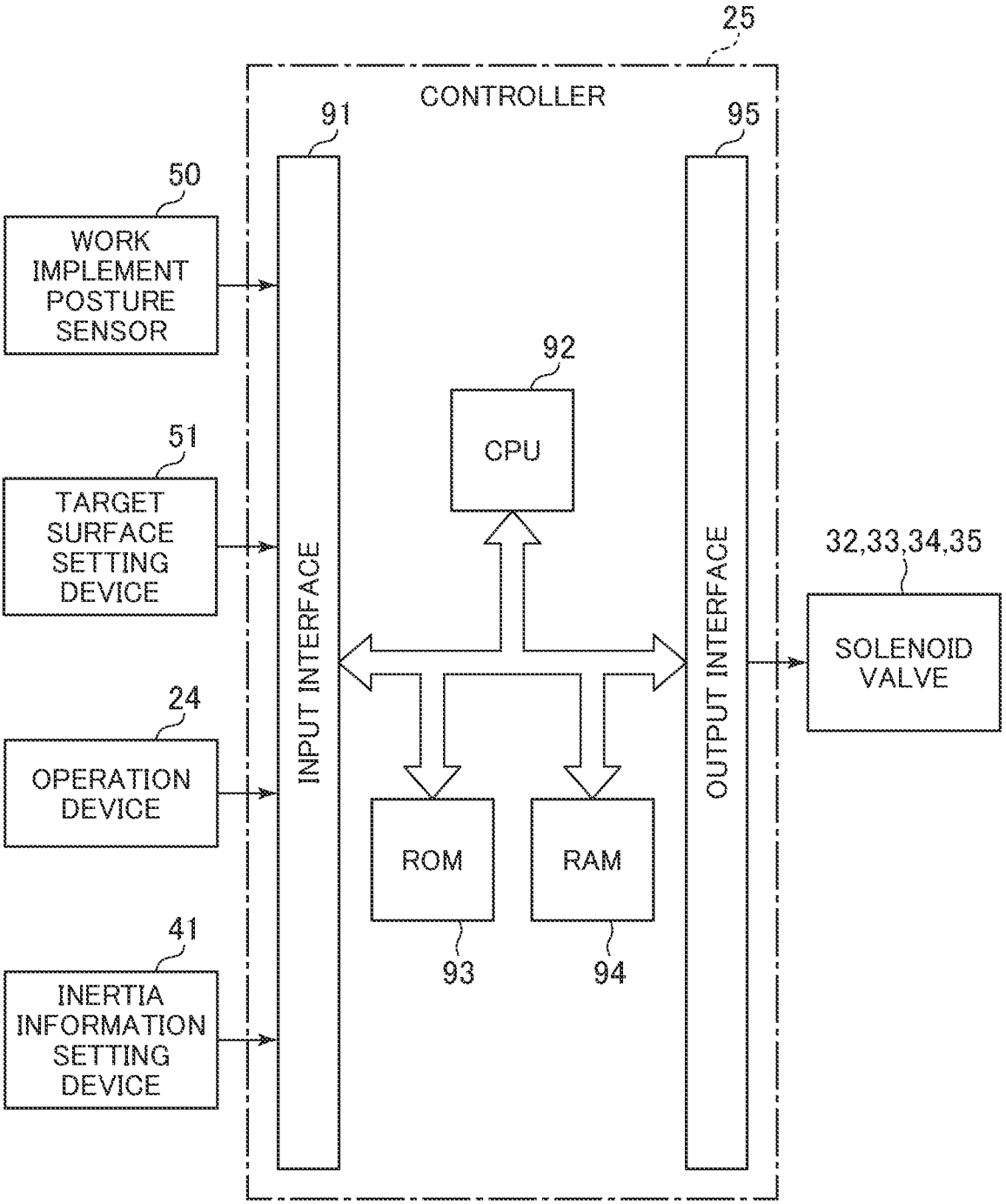
FIG. 4 is a schematic view of a hardware configuration of a controller 25.

FIG. 4 is a schematic view of a hardware configuration of the controller 25. Referring to FIG. 4, the controller 25 includes an input interface 91, a central processing unit (CPU) 92 that is a processor, a read only memory (ROM) 93 and a random access memory (RAM) 94 that are storage devices, and an output interface 95.

Inputted to the input interface 91, signals from the tilt sensors 17, 18, 19 and 20, voltage values (operation signals) from the operation device 24, a signal from a target surface setting device 51, and signals from an inertia information setting device 41. The tilt sensors 17, 18, 19 and 20 configure a work implement posture sensor 50 that detects the posture of the work implement 7. The voltage values or operation signals from the operation device 24 indicate operation amounts and operation directions of the operation levers 24*a*, 24*b* and 24*c*. The target surface setting device 51 is a device for setting a target surface 60 that becomes a reference to an excavation work or a fill work by the work implement 7. The inertia information setting device 41 is a device for setting inertia data such as the mass, inertial moment and so forth of the boom 8, arm 9 and bucket 10. The inertia information setting device 41 converts the inputted signals such that the CPU 92 can perform calculation with the signals.

Figure 5:
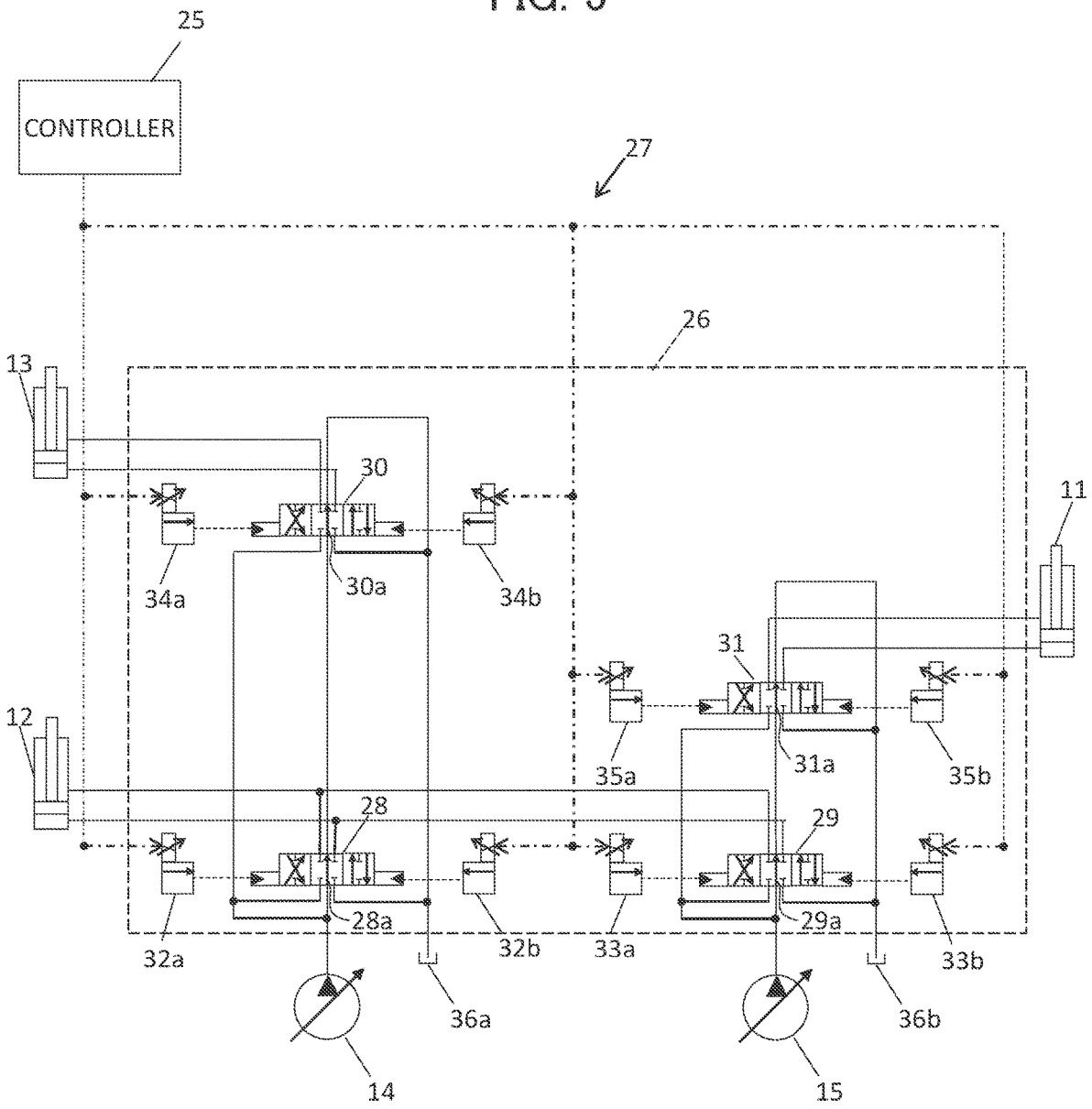
FIG. 5 is a schematic view of a hydraulic circuit 27 of the hydraulic excavator 1.

The ROM 93 is a recording medium in which control programs for allowing the controller 25 to execute various control processes including processes hereinafter described with reference to a flow chart and various kinds of data and so forth necessary for execution of the control processes. The CPU 92 performs a predetermined calculation process for signals fetched thereto from the input interface 91, ROM 93 and RAM 94 in accordance with the control programs stored in the ROM 93. The output interface 95 generates and outputs a signal for outputting according to a result of the calculation by the CPU 92. As the signal for outputting of the output interface 95, control commands for the solenoid valves 32, 33, 34 and 35 (depicted in FIG. 5 are available, and the solenoid valves 32, 33, 34 and 35 act on the basis of the control commands to control the hydraulic cylinders 11, 12 and 13. It is to be noted that, although the controller 25 of FIG. 4 includes semiconductor memories including the ROM 93 and RAM 94 as the storage devices, they can be replaced particularly by any storage device, and the controller 25 may include a magnetic storage device such as, for example, a hard disk drive.

The flow control valve device 26 includes a plurality of electromagnetically drivable spools and drives a plurality of hydraulic actuators incorporated in the hydraulic excavator 1 and including the hydraulic cylinders 11, 12 and 13 by changing the opening area (the restrictor opening), of each spool on the basis of a control command outputted from the controller 25.

FIG. 5 is a schematic view of the hydraulic circuit 27 of the hydraulic excavator 1. The hydraulic circuit 27 includes a first hydraulic pump 14, a second hydraulic pump 15, a flow control valve device 26, and hydraulic working fluid tanks 36*a* and 36*b*.

The flow control valve device 26 includes a first arm spool 28, a second arm spool 29, a bucket spool 30, a boom spool 31, first arm spool driving solenoid valves 32*a* and 32*b*, second arm spool driving solenoid valves 33*a* and 33*b*, bucket spool driving solenoid valves 34*a* and 34*b*, and boom spool driving solenoid valves 35*a* and 35*b*. The first arm spool 28 is a first flow control valve for controlling the flow rate of hydraulic working fluid to be supplied from the first hydraulic pump 14 to the arm cylinder 12. The second arm spool 29 is a third flow control valve that controls the flow rate of hydraulic working fluid to be supplied from the second pump 15 to the arm cylinder 12. The bucket spool 30 controls the flow rate of hydraulic working fluid to be supplied from the first hydraulic pump 14 to the bucket cylinder 13. The boom spool (first boom spool) 31 is a second flow control valve for controlling the flow rate of hydraulic working fluid to be supplied from the second hydraulic pump 15 to the boom cylinder 11. The first arm spool driving solenoid valves 32*a* and 32*b* generate a pilot pressure for driving the first arm spool 28. The second arm spool driving solenoid valves 33*a* and 33*b* generate a pilot pressure for driving the second arm spool 29. The bucket spool driving solenoid valves 34*a* and 34*b* generate a pilot pressure for driving the bucket spool 30. The boom spool driving solenoid valves (first boom spool driving solenoid valves) 35*a* and 35*b* generate a pilot pressure for driving the boom spool 31.

The first arm spool 28 and the bucket spool 30 are connected in parallel to the first hydraulic pump 14, and the second arm spool 29 and the boom spool 31 are connected in parallel to the second hydraulic pump 15.

The flow control valve device 26 is a device of an open center type (a center bypass type). The spools 28, 29, 30 and 31 have center bypass portions 28*a*, 29*a*, 30*a* and 31*a*, respectively, which are flow paths for guiding hydraulic working fluid discharged from the first and second hydraulic pumps 14 and 15 to the hydraulic working fluid tanks 36*a* and 36*b*, respectively, until a predetermined spool position is reached from a neutral position. In the present embodiment, the first hydraulic pump 14, center bypass portion 28*a* of the first arm spool 28, center bypass portion 30*a* of the bucket spool 30 and tank 36*a* are connected in series in this order, and the center bypass portion 28*a* and the center bypass portion 30*a* configure a center bypass flow path for guiding hydraulic working fluid discharged from the first hydraulic pump 14 to the tank 36*a*. Meanwhile, the second hydraulic pump 15, center bypass portion 29*a* of the second arm spool 29, center bypass portion 31*a* of the boom spool 31 and the tank 36*b* are connected in series in this order, and the center bypass portion 29*a* and the center bypass portion 31*a* configure a center bypass flow path for guiding hydraulic working fluid discharged from the second hydraulic pump 15 to the tank 36*b*.

To the solenoid valves 32, 33, 34 and 35, pressurized fluid discharged from a pilot pump (not depicted) that is driven by the engine 16 is guided. The solenoid valves 32, 33, 34 and 35 suitably act on the basis of a control command from the controller 25 to cause the pressurized fluid, which is a pilot pressure, from the pilot pump to act upon driving portions of the spools 28, 29, 30 and 31 thereby to drive the spools 28, 29, 30 and 31 to operate the hydraulic cylinders 11, 12 and 13.

For example, in the case where a command is issued from the controller 25 to operate the arm cylinder 12 in its extension direction, the command is outputted to the first arm spool driving solenoid valve 32*a* and the second arm spool driving solenoid valve 33*a*. In the case where a command is issued to operate the arm cylinder 12 in its contraction direction, the command is outputted to the first arm spool driving solenoid valve 32*b* and the second arm spool driving solenoid valve 33*b*. In the case where a command is issued to operate the bucket cylinder 13 in its extension direction, the command is outputted to the bucket spool driving solenoid valve 34*a*, but in the case where a command is issued to operate the bucket cylinder 13 in its contraction direction, the command is outputted to the bucket spool driving solenoid valve 34*b*. In the case where a command is outputted to operate the boom cylinder 11 in its extension direction, the command is outputted to the boom spool driving solenoid valve 35*a*, and in the case where a command is issued to the boom cylinder 11 to operate in its contraction direction, the command is outputted to the boom spool driving solenoid valve 35*b*.

Figure 6:
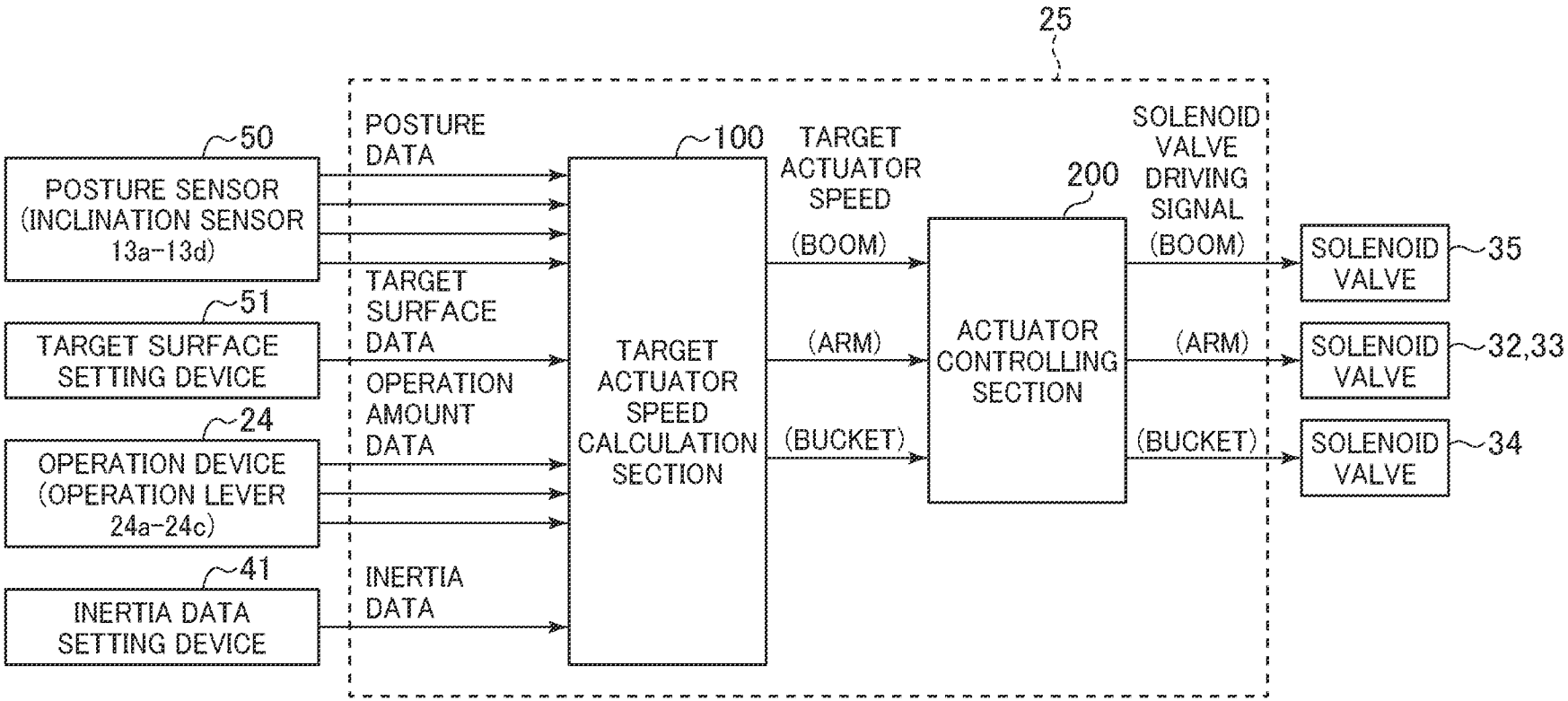
FIG. 6 is a functional block diagram of the controller 25 according to a first embodiment.

FIG. 6 depicts a functional block diagram in which processes executed by the controller 25 according to the present embodiment are classified and summarized into a plurality of blocks from the functional aspect. As depicted in FIG. 6, the controller 25 functions as a target actuator speed calculation section 100 that calculates a target speed (a target actuator speed), for each of the hydraulic cylinders 11, 12 and 13, and an actuator controller 200 that calculates a solenoid valve driving signal on the basis of the target actuator speed and outputs the solenoid valve driving signal to the applicable one of the solenoid valves 32, 33, 34 and 35.

The target actuator speed calculation section 100 calculates target speeds for the boom cylinder 11, arm cylinder 12 and bucket cylinder 13 as target actuator speeds on the basis of operation amount data obtained from the operation signals (voltage values) of the operation devices 24*a* to 24*c*, posture data of the work implement 7 (which includes the front members 8, 9 and 10), and the swing structure 3 obtained from detection signals of the tilt sensors 13*a* to 13*d* as the work implement posture sensor 50, position data of the target surface 60 (target surface data), defined on the basis of an input from the target surface setting device 51, and inertia data of the front members 8, 9 and 10 defined on the basis of an input from the inertia information setting device 41.

Figure 7:
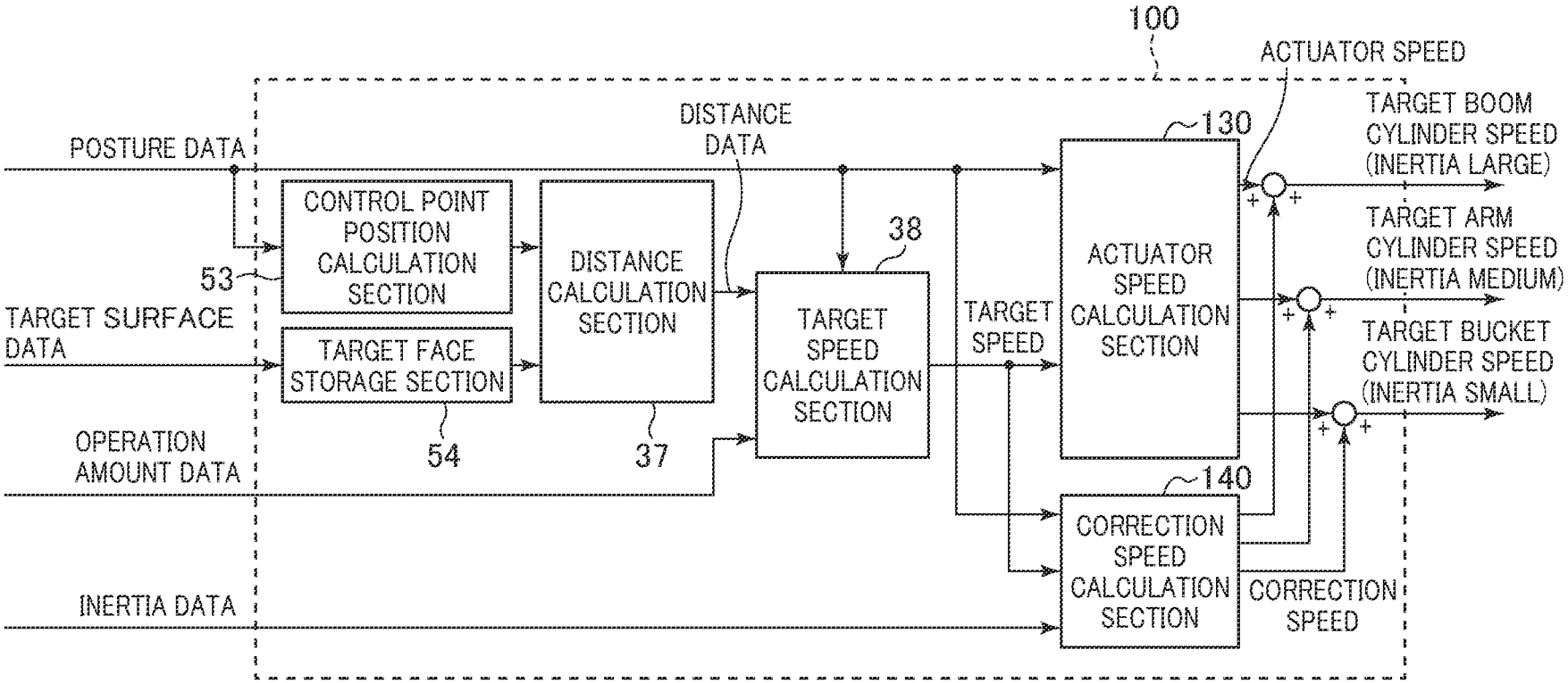
FIG. 7 is a functional block diagram of a target actuator speed calculation section 100 according to the first embodiment.

FIG. 7 is a functional block diagram of the target actuator speed calculation section 100. The target actuator speed calculation section 100 includes a control point position calculation section 53, a target surface storage section 54, a distance calculation section 37, a target speed calculation section 38, an actuator speed calculation section 130 and a correction speed calculation section 140.

The control point position calculation section 53 calculates the position of the bucket distal end P4 that is a control point of the present embodiment in the global coordinate system and the posture of each of the front members 8, 9 and 10 of the work implement 7 in the global coordinate system. Although it is sufficient if the calculation is based on a known method, for example, from navigation signals received by the GNSS antennae 21 and 22, coordinate values of the origin P0 (depicted in FIG. 2) of the local coordinate system (of the machine body reference coordinate system), in the global coordinate system and the posture data-orientation data of the track structure 2 and the swing structure 3 in the global coordinate system are calculated first. Then, utilizing results of this calculation, data of the inclination angles θ1, θ2, θ3 and θ4 from the work implement posture sensor 50, coordinate values of the boom foot pin P1 in the local coordinate system, and a boom length L1, an arm length L2 and a bucket length L3, the position of the bucket distal end P4 that is the control point of the present embodiment in the global coordinate system and the postures of the front members 8, 9 and 10 of the work implement 7 in the global coordinate system are calculated. It is to be noted that the coordinate values of the control point of the work implement 7 may be measured by an external measurement instrument such as a laser surveying meter and acquired by communication with the external measurement instrument.

The target surface storage section 54 has stored therein position data (target surface data), of the target surface 60, which is calculated on the basis of data from the target surface setting device 51 located in the operation room 4, in the global coordinate system. In the present embodiment, as depicted in FIG. 2, a cross sectional shape when three-dimensional data of the target surface is cut along the plane in which each of the front members 8, 9 and 10 of the work implement 7 acts (along the action plane of the work machine), is utilized as the target surface 60 (which is a two-dimensional target surface). It is to be noted that, although the number of such target surfaces 60 in the example of FIG. 2 is one, a plurality of target planes may exist. In the case where a plurality of target surfaces exist, for example, a method that sets a surface having the shortest distance from the control point of the work implement 7 as the target surface, another method that sets a surface positioned vertically below the bucket distal end P4 as the target surface, a further method that sets an arbitrarily selected surface as the target surface and so forth are available. Further, as the position data of the target surface 60, position data of a target surface 60 around the hydraulic excavator 1 may be acquired by communication from an external server on the basis of position data of the control point of the work implement 7 in the global coordinate system and stored into the target surface storage section 54.

The distance calculation section 37 calculates the distance D (depicted in FIG. 2) between the control point of the work implement 7 and the target surface 60 from the position data of the control point of the work implement 7 calculated by the control point position calculation section 53 and the position data of the target surface 60 acquired from the target surface storage section 54.

The target speed calculation section 38 is an element that calculates the target speeds for the front members 8, 9 and 10 (the boom target speed, arm target speed and bucket target speed), in response to the distance D such that, at the time of operation of the operation device 24, the range of action of the work implement 7 is limited to a position on or above the target surface 60. In the present embodiment, the target speed calculation section 38 performs the following calculations.

First, the target speed calculation section 38 calculates a demanded speed to the boom cylinder 11 (a boom cylinder demanded speed), from a voltage value (which is a boom operation amount), inputted from the boom operation lever 24*a*; calculates a demanded speed to the arm cylinder 12 (an arm cylinder demanded speed), from a voltage value (which is an arm cylinder demanded speed), inputted from the arm operation lever 24*b*; and calculates a demanded speed to the bucket cylinder 13 (a bucket cylinder demanded speed), from a voltage value) which is a bucket operation amount), inputted from the bucket operation lever 24*c*. The target speed calculation section 38 calculates three speed vectors to be generated at the bucket distal end P4 by the three cylinder demanded speeds from the calculated three cylinder demanded speeds and the postures of the front members 8, 9 and 10 of the work implement 7 calculated by the control point position calculation section 53. Then, the target speed calculation section 38 determines the sum of the three speed vectors as a speed vector V0, namely, as a demanded speed vector, of the work implement 7 at the bucket distal end P4. Then, the target speed calculation section 38 calculates also a speed component V0*z* in the target surface vertical direction and a speed component V0*x* in the target surface horizontal direction of the speed vector V0.

Figure 8:
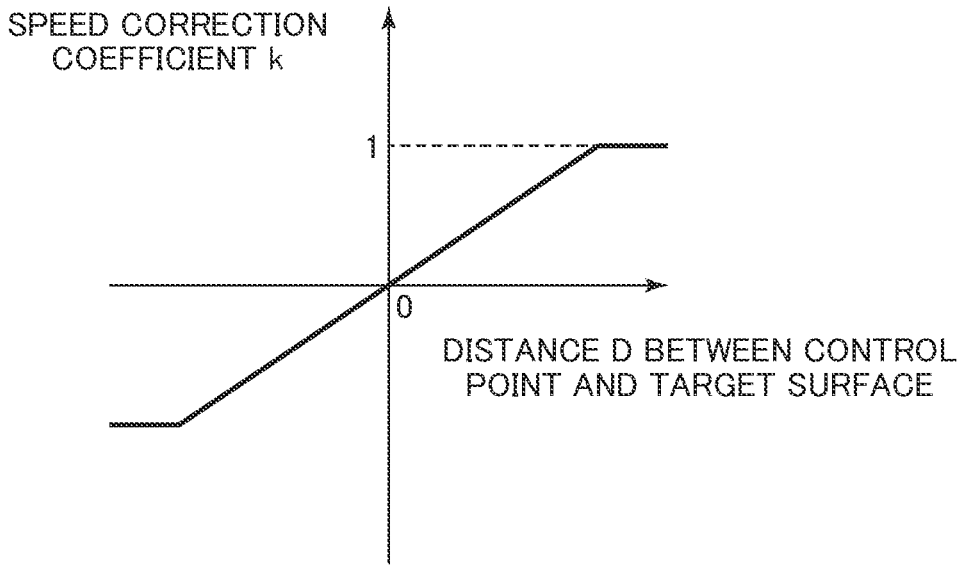
FIG. 8 is a graph illustrating a relationship between a distance D between a bucket distal end P4 and a target surface 60 and a speed correction coefficient k.

Then, the target speed calculation section 38 calculates a correction coefficient k that is determined in response to the distance D. FIG. 8 is a graph representative of a relationship between the distance D between the bucket distal end P4 and the target surface 60 and the speed correction coefficient k. A distance when the bucket distal end P4, namely (the control point of the work implement 7), is positioned above the target surface 60 is made positive and a distance when the bucket distal end P4 is positioned below the target surface 60 is made negative, and when the distance D is in the positive, the target speed calculation section 38 outputs a positive correction coefficient, but when the distance D is in the negative, the target speed calculation section 38 outputs a negative correction coefficient, as a value equal to or lower than 1. It is to be noted that, in regard to the speed vector, the direction in which the target surface 60 is approached from above the target surface 60 is made positive.

Then, the target speed calculation section 38 multiplies the speed component V0*z* of the speed vector V0 in the target surface vertical direction by the correction coefficient k determined in response to the distance D to calculate a speed component V1*z*. The target speed calculation section 38 synthesizes the speed component V1*z* and the speed component V0*x* of the speed vector V0 in the target surface horizontal direction to calculate a synthetic speed vector (a target speed vector) V1. Then, in order to allow the actions of the three hydraulic cylinders 11, 12 and 13 to generate the synthetic speed vector V1 at the bucket distal end P4, the target speed calculation section 38 calculates speed vectors, which are to be generated at the bucket distal end P4 by the three hydraulic cylinders 11, 12 and 13, as target speeds for the front members 8, 9 and 10 corresponding to the three hydraulic cylinders. The target speeds for the front members 8, 9 and 10 are speed vectors having start points at the bucket distal end P4 and particularly include a target speed (boom target speed) for the speed that is generated at the bucket distal end P4 by action of the boom 8 driven by the boom cylinder 11 (for the bucket distal end speed), a target speed (arm target speed) that is generated at the bucket distal end P4 by action of the arm 9 driven by the arm cylinder 12, and a target speed (bucket target speed) that is generated at the bucket distal end P4 by the bucket 10 driven by the bucket cylinder 13. The target speed calculation section 38 calculates the boom target speed, arm target speed and bucket target speed every moment and outputs a set of the three times series as target speed signals for the front members 8, 9 and 10 to the actuator speed calculation section 130 and the correction speed calculation section 140.

Figure 9:
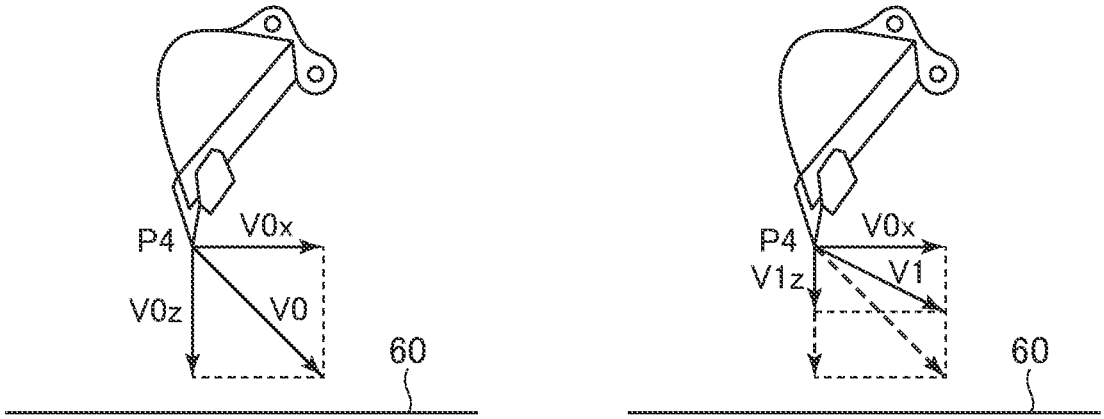
FIG. 9 is a schematic view representing speed vectors before and after correction according to the distance D of the bucket distal end P4.

FIG. 9 is a schematic view representing speed vectors at the bucket distal end P4 before and after correction according to the distance D. By multiplying the component V0*z* (depicted in the left figure of FIG. 9), of the demanded speed vector V0 in the target surface vertical direction by the speed correction coefficient k, the speed vector V1*z* in the target surface vertical direction equal to or less than V0*z* (depicted in the right figure of FIG. 9) is obtained. A synthetic speed component V1 of V1*z* and V0*x* that is a component of the speed vector V0 in the target surface horizontal direction is calculated, and an arm target speed, a boom target speed and a bucket target speed with which V1 can be outputted are calculated.

As one of methods for calculating the target speeds for the front members 8, 9 and 10 (the boom target speed, arm target speed and bucket target speed), from the synthetic speed vector V1, a method is available which determines speed vectors to be generated at the bucket distal end P4 by an arm cylinder demanded speed and a bucket cylinder demanded speed as an arm target speed and a bucket target speed, respectively, subtracts the sum of the arm target speed and the bucket target speed from the synthetic speed vector V1 and determines a speed vector obtained by the subtraction as a boom target speed. However, this calculation is nothing but a mere example, and any other calculation method may be used if a synthetic speed vector V1 is obtained by the calculation method.

The actuator speed calculation section 130 geometrically calculates and outputs the speeds of the hydraulic cylinders 11, 12 and 13, namely, (the boom cylinder speed, arm cylinder speed and bucket cylinder speed (actuator speeds)), necessary to generate target speeds for the front members 8, 9 and 10 on the basis of the target speeds for the front members 8, 9 and 10 (the boom target speed, arm target speed and bucket target speed), inputted from the target speed calculation section 38 and the posture data from the work implement posture sensor 50.

The correction speed calculation section 140 calculates correction speeds for correcting the speeds of the hydraulic cylinders 11, 12 and 13 (which are the boom cylinder speed, arm cylinder speed and bucket cylinder speed), calculated by the actuator speed calculation section 130 (a boom cylinder correction speed, an arm cylinder correction speed and a bucket cylinder correction speed), on the basis of the posture data from the work implement posture sensor 50, data of the target speeds for the front members 8, 9 and 10 from the target speed calculation section 38 and inertia data from the inertia data setting device 41. Although, in the present embodiment, the target actuator speeds are calculated by adding correction speeds to the speeds of the hydraulic cylinders 11, 12 and 13 calculated by the actuator speed calculation section 130, the method for correction is not limited to this. Now, details of the correction speed calculation section 140 are described with reference to FIG. 14.

Figure 10:
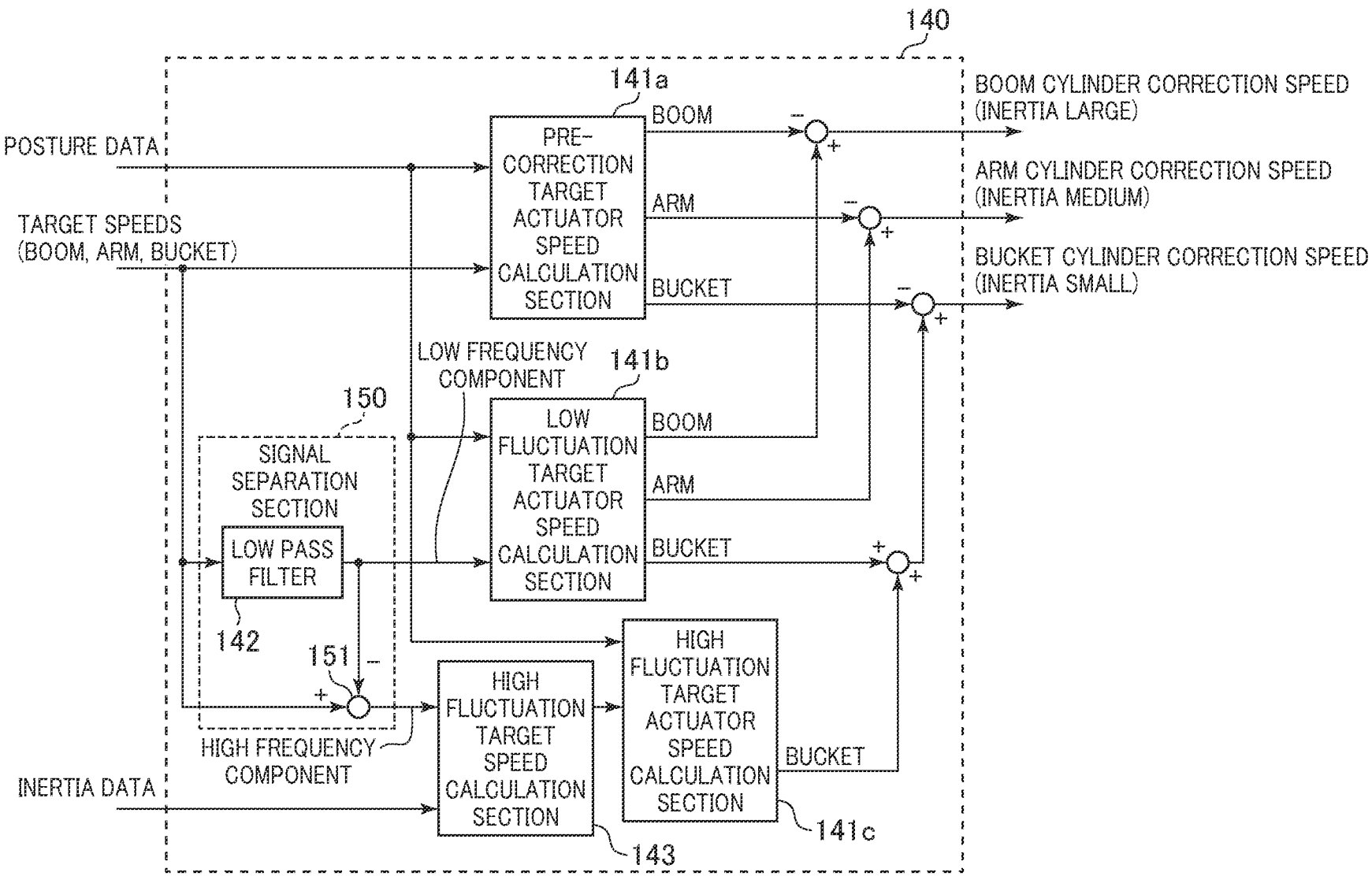
FIG. 10 is a functional block diagram of a correction speed calculation section 140 in the first embodiment.

FIG. 10 is a functional block diagram of the correction speed calculation section 140. As depicted in FIG. 10, the correction speed calculation section 140 includes a signal separation section 150, a high fluctuation target speed calculation section 143, a pre-correction target actuator speed calculation section 141*a*, a low fluctuation target actuator speed calculation section 141*b* and a high fluctuation target actuator speed calculation section 141*c*.

Figure 11:
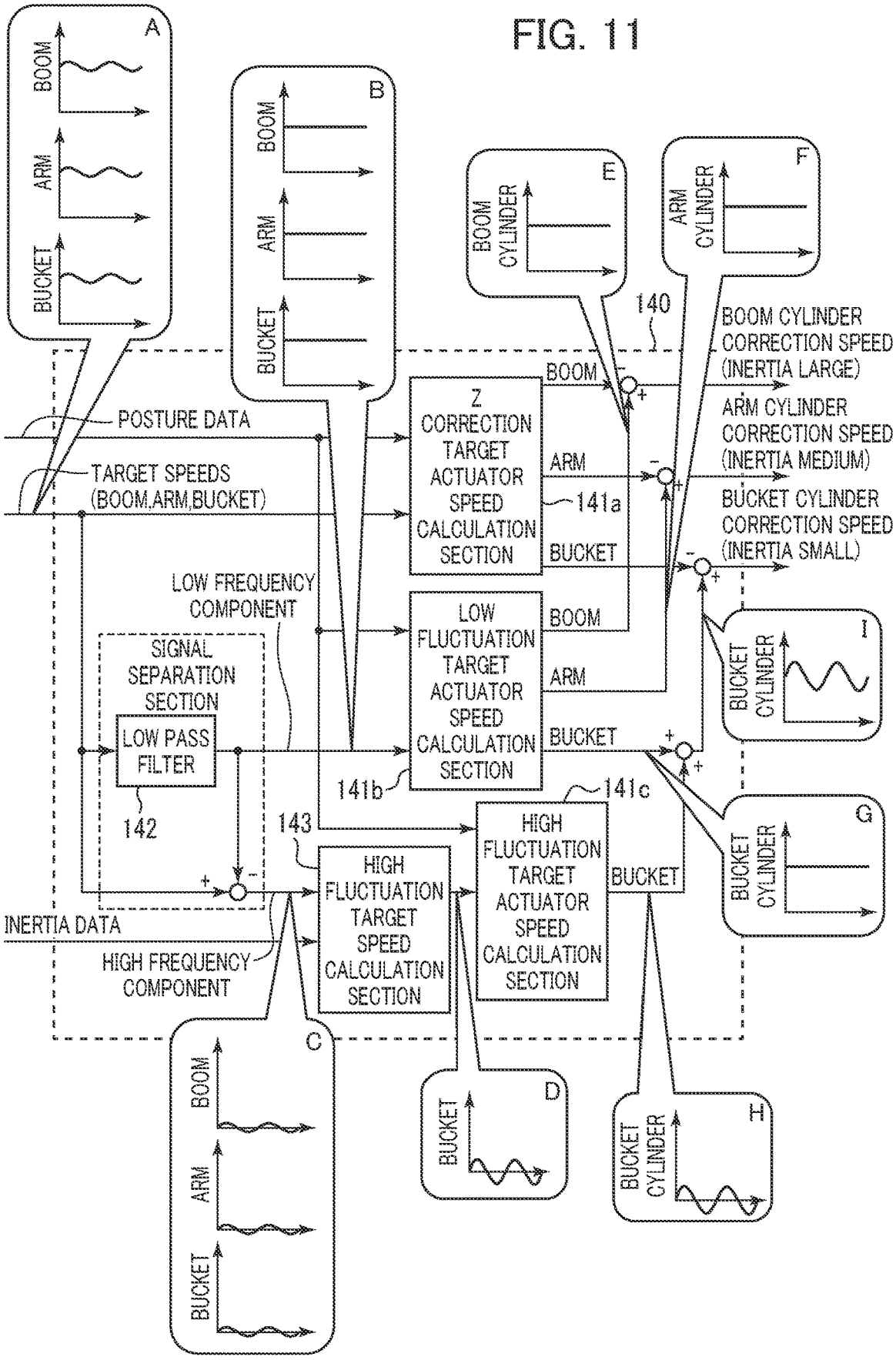
FIG. 11 is a view depicting an example of target speed signals for front members and target actuator speeds in an overlapping relationship on FIG. 10.

In FIG. 11, an example of A) signals of target speeds for the three front members 8, 9 and 10 inputted from the target speed calculation section 38, B) low frequency components of target speed signals for the front members 8, 9 and 10 outputted from the signal separation section 150, C) high frequency components of the target speed signals for the front members 8, 9 and 10 outputted from the signal separation section 150, D) a high frequency component of the target speed signal for the bucket 10 outputted from the high fluctuation target speed calculation section 143, E) a low frequency component of the target speed signal (which is a target speed signal after correction), for the boom cylinder 11 outputted from the low fluctuation target actuator speed calculation section 141*b*, F) a low frequency component of the target speed signal (which is a target speed signal after correction), for the arm cylinder 12 outputted from the low fluctuation target actuator speed calculation section 141*b*, G) a low frequency component of the target speed signal for the bucket cylinder 13 outputted from the low fluctuation target actuator speed calculation section 141*b*, H) a high frequency component of the target speed signal for the bucket cylinder 13 outputted form the high fluctuation target actuator speed calculation section 141*c* and I) the target speed signal (which is a target speed signal after correction), for the bucket cylinder 13 is represented in an overlapping relationship. The alphabetical capital letters coincide with those indicated in balloons in FIG. 11.

The signal separation section 150 is an element that separates each of signals (depicted in a balloon A of FIG. 11), of the target speeds for the three front members 8, 9 and 10 (the boom target speed, arm target speed and bucket target speed), inputted from the target speed calculation section 38, into a low frequency component (depicted in a balloon B of FIG. 11), of a frequency lower than a predetermined threshold value (which is a shield frequency), and a high frequency component (depicted in a balloon C of FIG. 11), having a frequency higher than the threshold value. The signal separation section 150 in the present embodiment includes a low pass filter section 142 for separating a low frequency component from a target speed and a frequency component separation section (high pass filter section) 151 that separates a high frequency component from the target speed. The shielding frequency can be determined taking the limit of the responsiveness of the boom 8 or the arm 9 having a relatively high inertial load into consideration.

The low pass filter section 142 passes components of lower frequencies than a predetermined threshold value (shielding frequency), namely, (low frequency components), from within signals of the target speeds for the front members 8, 9 and 10 but reduces components of frequencies higher than the threshold value to separate the low frequency components (depicted in the balloon B of FIG. 11) from the target speed signals. Consequently, in the case where a change of a target speed signal per time is large, the target speed signal is attenuated in response to the shielding frequency. The low frequency components separated by the low pass filter section 142 exist for each of the front members 8, 9 and 10 similarly to the target speeds and are outputted to the frequency component separation section 151 and the low fluctuation target actuator speed calculation section 141*b*.

The frequency component separation section 151 subtracts the low frequency components from the low pass filter section 142 from the target speed signals for the three front members 8, 9 and 10 inputted from the target speed calculation section 38 and outputs the remaining target speed signals for the front members 8, 9 and 10 as high frequency components (depicted in the balloon C of FIG. 11). The high frequency components are outputted to the high fluctuation target speed calculation section 143. It is to be noted that the frequency component separation section 151 may otherwise be configured from a high pass filter that passes components of frequencies higher than the threshold value (shielding frequency) of the low pass filter section 142 (high frequency components), from within the target speed signals for the front members 8, 9 and 10 but reduces components of frequencies lower than the threshold value to separate the high frequency components from the target speed signals. However, if a target speed component obtained by subtracting a low frequency component outputted from the low pass filter section 142 from a target speed component outputted from the target speed calculation section 38 is determined as a high frequency component as in the present embodiment, then since the sum of the low frequency component and the high frequency component outputted from the signal separation section 150 can be kept to the original target speed, the target speed can be prevented from changing before and after it passes the signal separation section 150.

The high fluctuation target speed calculation section 143 refers to the inertia data obtained from the inertia information setting device 41 to allocate the high frequency components separated by the signal separation section 150 preferentially to a front member or members whose inertial load is relatively small from among the three front members 8, 9 and 10 to calculate high fluctuation target speeds for the three front members. In the present embodiment, all frequency components are allocated to the bucket 10 whose inertial load is smallest from among the three front members 8, 9 and 10 (as depicted in a balloon D of FIG. 11), and the high fluctuation target speed for the boom 8 and the arm 9 is zero. Especially in the present embodiment, speed components perpendicular to the target surface 60 of the target speeds defined by the high frequency components of the three front members 8, 9 and 10 separated by the signal separation section 150 are calculated, and the sum of the three perpendicular speed components is determined as the high fluctuation target speed for the bucket 10. If the high fluctuation target speed for the bucket 10 is restricted to the perpendicular component in this manner, then the perpendicular component V1*z* (depicted on the right side in FIG. 9) is maintained although there is the possibility that the horizontal component V0*x* (depicted on the right side in FIG. 9), of the synthetic speed vector V1 may be changed by the speed correction of the correction speed calculation section 140. Therefore, while entering of the packet distal end P4 to a position below the target surface 60 is prevented, geometric transformation of a speed vector is facilitated.

The pre-correction target actuator speed calculation section 141*a* calculates the speeds of the boom cylinder 11, arm cylinder 12 and bucket cylinder 13 (the actuator speeds), necessary to generate the three target speeds (bucket distal end speed) and hence the packet distal end speed, utilizing geometric transformation from the signals of the target speeds for the three front members 8, 9 and 10 (the boom target speed, arm target speed and bucket target speed), inputted from the target speed calculation section 38 and the posture data at the time. The actuator speeds have values equal to those outputted from the actuator speed calculation section 130 and are sometimes referred to each as "pre-correction target actuator speed."

The low fluctuation target actuator speed calculation section 141*b* calculates, from the low frequency components of the target speed signals for the three front members 8, 9 and 10 inputted from the signal separation section 150 and the posture data at the time, the actuator speeds necessary to generate the three low frequency components, namely, the speed of the boom cylinder 11 (depicted in a balloon E of FIG. 11), the speed of the arm cylinder 12 (depicted in a balloon F of FIG. 11) and the speed of the bucket cylinder 13 (depicted in a balloon G of FIG. 11), utilizing geometric transformation. Each of the actuator speeds is sometimes referred to as "low fluctuation target actuator speed."

The high fluctuation target actuator speed calculation section 141*c* calculates, from the high frequency components of the target speed signals for the three front members 8, 9 and 10 inputted from the high fluctuation target speed calculation section 143 and the posture data at the time, the speeds of the boom cylinder 11, arm cylinder 12 and bucket cylinder 13 necessary to generate the three high frequency components (the actuator speeds), utilizing geometric transformation. Each of the actuator speeds is sometimes referred to as "high fluctuation target actuator speed." It is to be noted that, since the high frequency components of the target speed signals for the boom 8 and the arm 9 inputted from the high fluctuation target speed calculation section 143 in the present embodiment is zero as described hereinabove, this results in calculation only of the speed of the bucket cylinder 13 (as depicted in a balloon H of FIG. 11).

According to the configuration described above, the correction speed calculation section 140 outputs the correction speeds individually of the hydraulic cylinders 11, 12 and 13. As the boom cylinder correction speed and the arm cylinder correction speed, the difference of the pre-correction target actuator speeds calculated by the pre-correction target actuator speed calculation section 141*a* from the low fluctuation target actuator speeds calculated by the low fluctuation target actuator speed calculation section 141*b* are outputted. As the bucket cylinder correction speed, the difference of the pre-correction target actuator speed calculated by the pre-correction target actuator speed calculation section 141*a* from the sum of the low fluctuation target actuator speed calculated by the low fluctuation target actuator speed calculation section 141*b* and the high fluctuation target actuator speed calculated by the high fluctuation target actuator speed calculation section 141*c* is outputted.

The correction speeds of the actuators obtained in this manner are added to the speeds of the hydraulic cylinders 11, 12 and 13 outputted from the actuator speed calculation section 130 depicted in FIG. 7 and are outputted as target actuator speeds (as a target boom cylinder speed, a target arm cylinder speed and a target bucket cylinder speed), from the target actuator speed calculation section 100 to the actuator controller 200 (depicted in FIG. 6). The calculation values of the actuator speed calculation section 130 and the pre-correction target actuator speed calculation section 141*a* are equal to each other, and as a result, the target boom cylinder speed outputted form the target actuator speed calculation section 100 becomes the low fluctuation target actuator speed (depicted in the balloon E of FIG. 11); the target arm cylinder speed becomes the low fluctuation target actuator speed (depicted in the balloon F of FIG. 11); and the target bucket cylinder speed becomes the speed of the sum of the low fluctuation target actuator speed and the high fluctuation target actuator speed (as depicted in a balloon I of FIG. 11).

Referring back to FIG. 6, upon calculation of solenoid valve driving signals for the solenoid valves 32, 33, 34 and 35, the actuator controller 200 utilizes a table in which target speeds for the hydraulic cylinders 11, 12 and 13 (target boom cylinder speeds, target arm cylinder speeds and target bucket cylinder speeds), and solenoid valve driving signals for the spool driving solenoid valves 35*a*, 35*b*, 32*a*, 32*b*, 33*a*, 33*b*, 34*a* and 34*b* for operating the spools 31, 28, 29 and 30 corresponding to the hydraulic cylinders 11, 12 and 13 are defined in a one-to-one correlation.

As this table, a table for the boom spool driving solenoid valve 35*a* that is utilized in the case where the boom cylinder 11 is to be extended and a table for the boom spool driving solenoid valve 35*b* that is utilized in the case where the arm cylinder 12 is to be contracted are available. Further, as two tables that are utilized in the case where the arm cylinder 12 is to be extended, a table of the first arm spool driving solenoid valve 32*a* and a table for the second arm spool driving solenoid valve 33*a* are available. Further, as two tables that are utilized in the case where the arm cylinder 12 is to be contracted, a table of the first arm spool driving solenoid valve 32*b* and a table for the second arm spool driving solenoid valve 33*b* are available. Furthermore, a table for the bucket spool driving solenoid valve 34*a* that is utilized in the case where the bucket cylinder 13 is to be extended and a table for the bucket spool driving solenoid valve 34*b* that is utilized in the case where the bucket cylinder 13 is to be contracted are available. In those eight tables, a correlation between a target speed and a current value is defined such that the current values to the solenoid valves 35*a*, 35*b*, 32*a*, 32*b*, 33*a*, 33*b*, 34*a* and 34*b* increase monotonously together with increase in magnitude of the target speeds for the hydraulic cylinders 11, 12 and 13 (the target actuator speeds), on the basis of a relationship between the current values to the solenoid valves 35*a*, 35*b*, 32*a*, 32*b*, 33*a*, 33*b*, 34*a* and 34*b* and the actual speeds of the hydraulic cylinders 11, 12 and 13 determined by an experiment or a simulation in advance.

For example, when a command of a target arm cylinder speed and a target boom cylinder speed are applicable, the actuator controller 200 generates control commands for the solenoid valves 32, 33 and 35 to drive the first arm spool 28, second arm spool 29 and boom spool 31. Consequently, the arm cylinder 12 and the boom cylinder 11 act on the basis of the target arm cylinder speed and the target boom cylinder speed, respectively.

Figure 12:
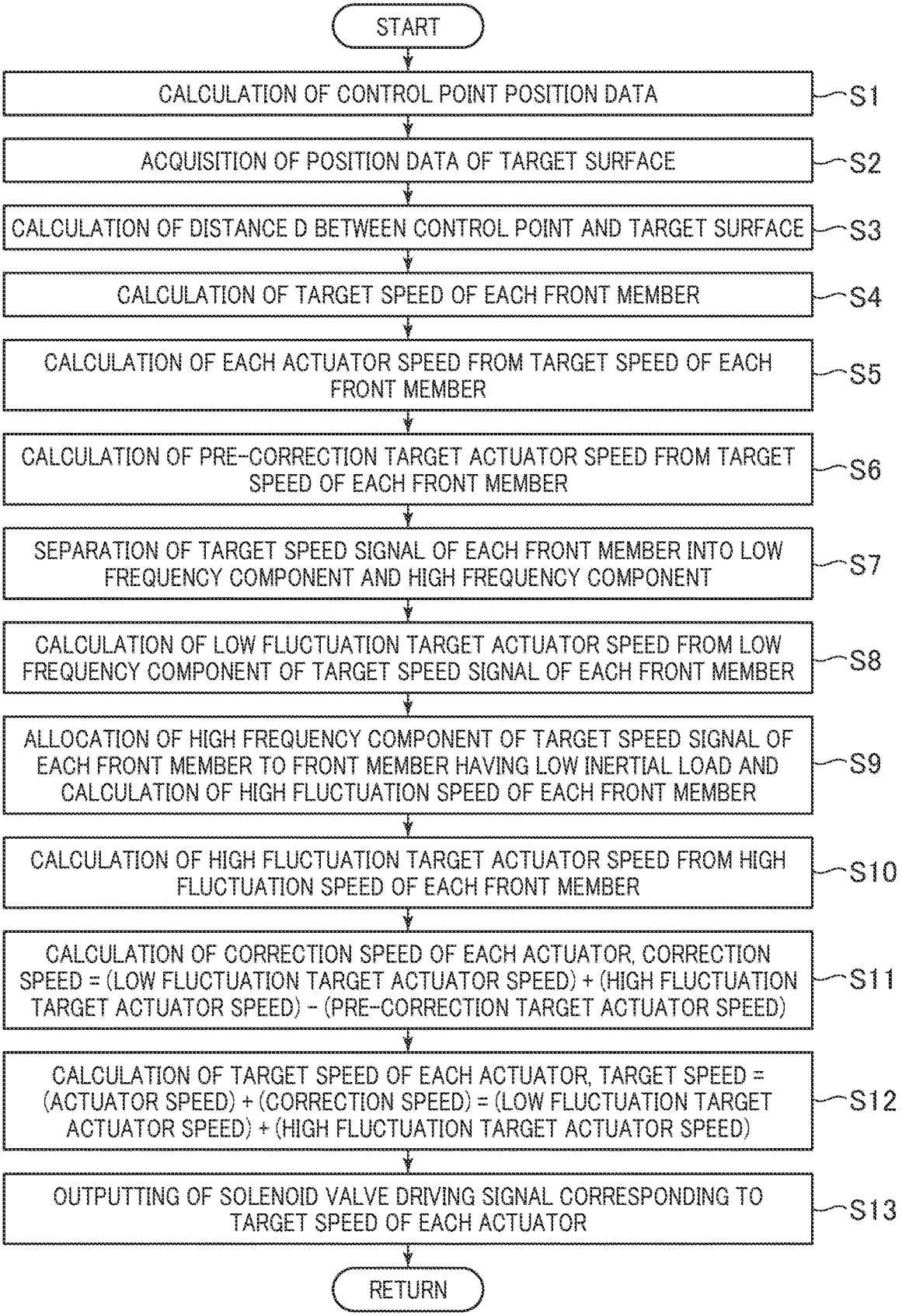
FIG. 12 is a flow chart representative of a control flow by the controller 25 according to the first embodiment.

FIG. 12 is a flow chart representative of a control flow by the controller 25. The controller 25 starts processing of FIG. 12 when the operation device 24 is operated by an operator, and the control point position calculation section 53 calculates position data of the bucket distal end P4 (which is the control point), in the global coordinate system on the basis of data of the inclination angles θ1, θ2, θ3 and θ4, position data, posture data (angle data) and orientation data of the hydraulic excavator 1 calculated from navigation signals of the GNSS antennae 21 and 22, the dimension data L1, L2 and L3 of the front members stored in advance and so forth (procedure S1).

In procedure S2, the distance calculation section 37 extracts and acquires position data of target surfaces (target surface data), included in a predetermined range with reference to the position data of the bucket distal end P4 in the global coordinate system calculated by the control point position calculation section 53 from the target surface storage section 54 (in this case, position data of the hydraulic excavator 1 may be utilized) in place of the position data of the bucket distal end P4. Then, a target surface positioned nearest to the bucket distal end P4 from among the target surfaces is set as a target surface 60 of a control target, namely, as a target surface 60 with reference to which the distance D is to be calculated.

In procedure S3, the distance calculation section 37 calculates the distance D on the basis of the position data of the bucket distal end P4 calculated in procedure S1 and the position data of the target surface 60 set in procedure S2.

In procedure S4, the target speed calculation section 38 calculates, on the basis of the distance D calculated in procedure S3 and operation amounts (voltage values) of the operation levels inputted from the operation device 24, target speeds for the front members 8, 9 and 10 such that the bucket distal end P4 is kept on or above the target surface 60 even if the work implement 7 acts.

In procedure S5, the actuator speed calculation section 130 calculates, on the basis of the target speeds for the front members 8, 9 and 10 calculated in procedure S4 and the position data of the work implement 7 obtained from the work implement posture sensor 50, speeds of the boom cylinder 11, arm cylinder 12 and bucket cylinder 13 (actuator speeds), necessary to generate the target speeds for the front members 8, 9 and 10 calculated in procedure S4.

In procedure S6, the pre-correction target actuator speed calculation section 141*a* calculates, on the basis of the target speeds for the front members 8, 9 and 10 calculated in procedure S4 and the posture data of the work implement 7 obtained from the work implement posture sensor 50, speeds of the boom cylinder 11, arm cylinder 12 and bucket cylinder 13 (pre-correction target actuator speeds), necessary to generate the target speeds for the front members 8, 9 and 10 calculated in procedure S4. It is to be noted that the pre-correction target actuator speeds calculated here have values equal to the actuator speeds calculated in procedure S5.

In procedure S7, the signal separation section 150 separates each of signals of the target speeds for the front members 8, 9 and 10 calculated in procedure S4 into a high frequency component and a low frequency component. Consequently, for example, as depicted in FIG. 11, the target speed in the balloon A is separated into a low frequency component (low fluctuation component) of the balloon B, which indicates a relatively small speed fluctuation per time, and a high frequency component (high fluctuation component) of the balloon C, which indicates a relatively large speed fluctuation per unit time.

In procedure S8, the low fluctuation target actuator speed calculation section 141*b* calculates, on the basis of the low frequency components of the target speed signals for the front members 8, 9 and 10 separated in procedure S7 and the posture data of the work implement 7 obtained from the work implement posture sensor 50, speeds of the boom cylinder 11, arm cylinder 12 and bucket cylinder 13 necessary to generate the low frequency components of the target speed signals for the front members 8, 9 and 10 separated in procedure S7 (low fluctuation target actuator speeds).

In procedure S9, the high fluctuation target speed calculation section 143 calculates components perpendicular to the target surface 60 from within the high frequency components of the target speed signals for the front members 8, 9 and 10 separated in procedure S7 and outputs the sum of all of the calculated perpendicular components as a high frequency component of the target speed signal for the bucket 10 to the high fluctuation target actuator speed calculation section 141*c*.

In procedure S10, the high fluctuation target actuator speed calculation section 141*c* calculates, on the basis of the high frequency component of the target speed signal for the bucket 10 calculated in procedure S9 and the posture data of the work implement 7 obtained from the work implement posture sensor 50, a speed of the bucket cylinder 13 necessary to generate the high frequency component of the target speed signal for the bucket 10 calculated in procedure S9 (a high fluctuation target actuator speed).

In procedure S11, the correction speed calculation section 140 calculates correction speeds for the actuators 11, 12 and 13. In the present embodiment, the correction speed for each of the actuators 11, 12 and 13 is the difference of the pre-correction target actuator speed (procedure S6) from the sum of the low fluctuation target actuator speed (procedure S8) and the high fluctuation target actuator speed (procedure S9) as depicted in FIG. 12. Such difference is calculated for each of the actuators 11, 12 and 13 and determined as a correction speed. In particular, the correction speed calculation section 140 outputs the difference of the boom cylinder speed (procedure S8) calculated by the pre-correction target actuator speed calculation section 141*a* from the boom cylinder speed (procedure S8) calculated by the low fluctuation target actuator speed calculation section 141*b* as a boom cylinder correction speed. Further, the correction speed calculation section 140 outputs the difference of the arm cylinder speed (procedure S6) calculated by the pre-correction target actuator speed calculation section 141*a* from the arm cylinder speed (procedure S8) calculated by the low fluctuation target actuator speed calculation section 141*b* as an arm cylinder correction speed. Furthermore, the correction speed calculation section 140 outputs the difference of the bucket cylinder speed (procedure S6) calculated by the pre-correction target actuator speed calculation section 141*a* from the sum of the bucket cylinder speed (procedure S8) calculated by the low fluctuation target actuator speed calculation section 141*b* and the bucket cylinder speed (procedure S9) calculated by the high fluctuation target actuator speed calculation section 141*c* as a bucket cylinder correction speed.

In procedure S12, the target actuator speed calculation section 100 calculates a target speed for each of the actuators 11, 12 and 13 (a target actuator speed). In the present embodiment, the target speeds for the actuators 11, 12 and 13 are the sums of the speeds of the actuators 11, 12 and 13 calculated in procedure S5 and the correction speeds for the actuators 11, 12 and 13 calculated in procedure S5 as depicted in FIG. 12. Since the speeds of the actuators 11, 12 and 13 calculated in procedure S5 have values equal to those of the pre-correction target actuator speeds calculated in procedure S6, the target speed for each of the actuators 11, 12 and 13 becomes the sum of the low fluctuation target actuator speed (procedure S8) calculated by the low fluctuation target actuator speed calculation section 141*b* and the high fluctuation target actuator speed (procedure S9) calculated by the high fluctuation target actuator speed calculation section 141*c*. In particular, the target actuator speed calculation section 100 outputs the boom cylinder speed (procedure S8) calculated by the low fluctuation target actuator speed calculation section 141*b* as a boom cylinder target speed. Further, the target actuator speed calculation section 100 outputs the arm cylinder speed (procedure S8) calculated by the low fluctuation target actuator speed calculation section 141*b* as an arm cylinder target speed. Furthermore, the target actuator speed calculation section 100 outputs the sum of the bucket cylinder speed (procedure S8) calculated by the low fluctuation target actuator speed calculation section 141*b* and the bucket cylinder speed (procedure S9) calculated by the high fluctuation target actuator speed calculation section 141*c* as a bucket cylinder target speed.

In procedure S13, the actuator controller 200 calculates a signal for driving the second flow rate control valve (boom spool) 31 on the basis of the boom cylinder target speed and outputs the signal to the solenoid valve 31*a* or the solenoid valve 31*b*. Similarly, the actuator controller 200 calculates signals for driving the first flow control valve (first arm spool) 28 and the third flow control valve (second arm spool) 29 on the basis of the arm cylinder target speed and outputs the signals the solenoid valve 32*a* and the solenoid valve 33*a* or the solenoid valve 32*b* and the solenoid valve 33*b*. Furthermore, the actuator controller 200 calculates a signal for driving the bucket spool (bucket spool) 30 on the basis of the bucket cylinder target speed and outputs the signal to the solenoid valve 34*a* or the solenoid valve 34*b*. Consequently, the actuators 11, 12 and 13 are driven on the basis of the target speeds therefor, namely (of the target actuator speeds therefor), to operate the front members 8, 9 and 10, respectively.

After the process in procedure S13 ends, it is confirmed that the operation of the operation device 24 continues and the processing returns to the top of the flow and repeats the processes in the procedures beginning with procedure S1. It is to be noted that, if the operation of the operation device 24 ends even in the middle of the flow of FIG. 12, the processing is encoded and it is waited that operation of the operation device 24 is started next.

In the hydraulic excavator 1 configured in such a manner as described above, the boom 8 and the arm 9 operate in accordance with target speed signals whose fluctuation per time is small (with low frequency components in the balloon B of FIG. 11) while a target speed signal that is excluded from the target speed signals for the boom 8 and the arm 9 and whose fluctuation per time is large (a high frequency component depicted in the balloon C of FIG. 11) is added to the target speed signal for the bucket 10 such that it is converted into action of the bucket 10. Since the bucket 10 has a relatively low inertial load in comparison with the boom 8 or the arm 9, it can respond rapidly also to a target speed signal whose fluctuation per time is large. In particular, even in a case in which the change of the target speed signal for any of the front members 8, 9 and 10 per time is so large that it exceeds the responsiveness of the boom 8 or the arm 9 whose inertial load is relatively large like, for example, a case in which, in a state in which the bucket distal end P4 is on the target surface 60 during finishing work of the target surface 60, the operator inputs a quick arm crowding operation in error, such exceeding amount is compensated for by action of the bucket 10 whose inertial load is relatively small. Since this makes it possible to make at least the perpendicular component of the actual speed vector of the packet distal end coincide with the target speed, stable semiautomatic excavation shaping control of high accuracy can be achieved.

Second Embodiment

Although, in the first embodiment described hereinabove, a frequency component of a target speed signal separated by the signal separation section 150 is allocated only to the bucket 10, it may otherwise be allocated only to the arm 9 in place of the bucket 10. Here, this case is described as a second embodiment of the present invention. It is to be noted that description of like elements to those of the embodiment described above is omitted (This similarly applies also to the succeeding embodiments).

Figure 13:
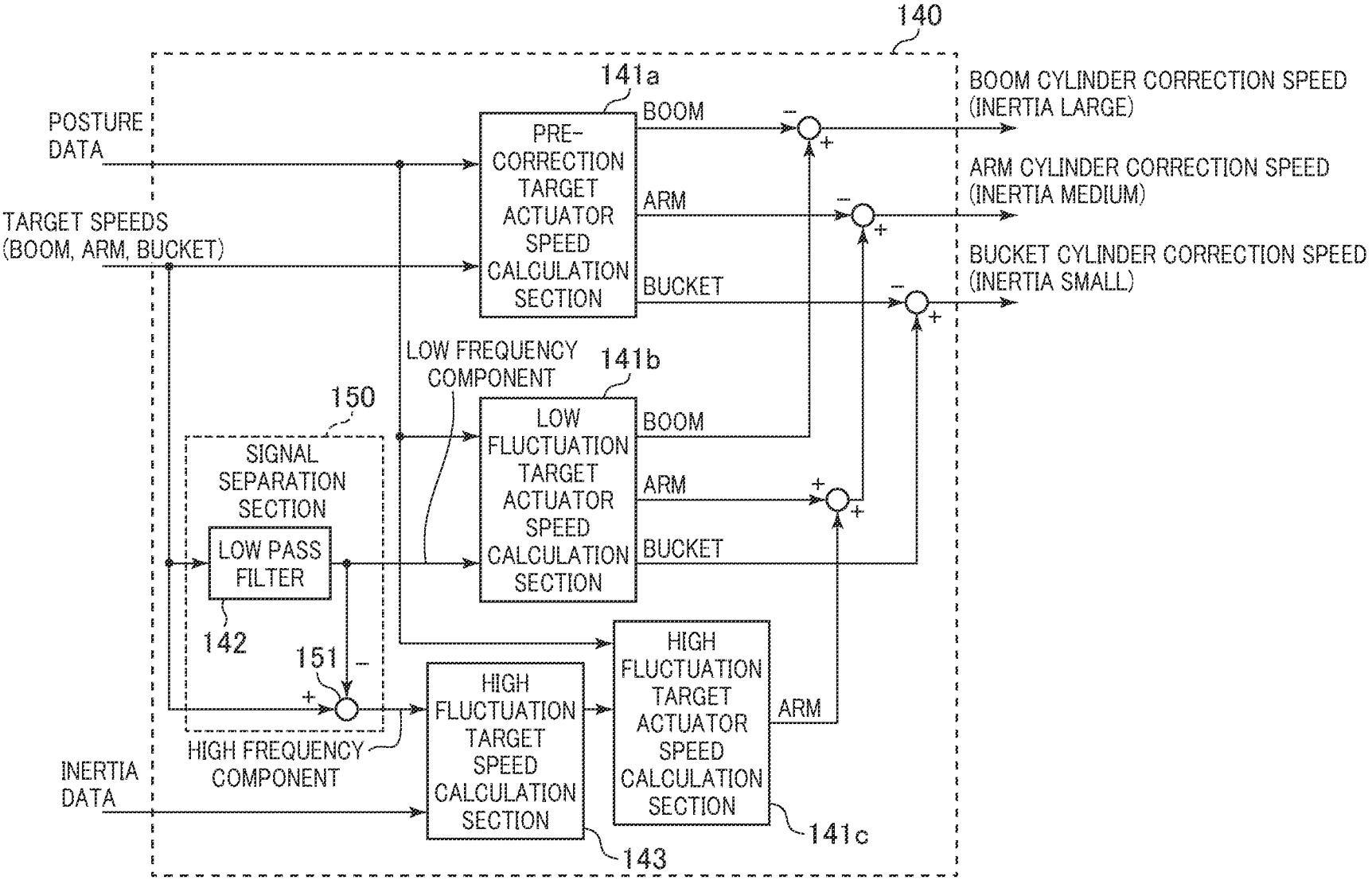
FIG. 13 is a functional block diagram of the correction speed calculation section 140 in a second embodiment.

FIG. 13 is a functional block diagram of the correction speed calculation section 140 in the second embodiment. As depicted in FIG. 13, the correction speed calculation section 140 has a configuration similar to that in the first embodiment. However, in the present embodiment, the high fluctuation target speed calculation section 143 allocates all high frequency components to the arm 9 from among the three front members 8, 9 and 10 while the high fluctuation target speed for the boom 8 and the bucket 10 is zero. It is to be noted that, also in the present embodiment, speed components, which are perpendicular to the target surface 60, of the target speeds defined by the high frequency components of the three front members 8, 9 and 10 separated by the signal separation section 150 are calculated, and the sum of the three perpendicular speed components is determined as the high fluctuation target speed for the arm 9.

In the first embodiment, even in the case where the operator does not operate the bucket 10, in the case where a high frequency component is generated in a target speed signal, there is the possibility that the bucket 10 may act to provide a discomfort feeling to the operator by semiautomatic excavation control. However, in the present embodiment configured in such a manner as described above, since a high frequency component generated in a target speed signal is allocated to the arm 9, the bucket 10 does not act unless an operation for the bucket 10 is performed. Therefore, the front member that is not operated by the operator (the bucket 10), is prevented from acting by semiautomatic excavation control, and the disagreeable feeling that may be provided to the operator can be moderated. Further, since the arm 9 has a small inertial load in comparison with the boom 8, even in the case where the number of times of fluctuation of a target speed signal per time is large, stable semiautomatic excavation control can be performed with high accuracy.

Third Embodiment

In the two embodiments described above, a high frequency component of a target speed signal separated by the signal separation section 150 is allocated to one of the bucket 10 and the arm 9. However, in the present embodiment, a high frequency component of a target speed signal is distributed to the front members 8, 9 and 10 at an appropriate ratio (at an appropriate distribution ratio), which is determined taking the inertial loads of the front members 8, 9 and 10 into consideration, so as to be added to low fluctuation target actuator speeds of the boom 8, arm 9 and bucket 10.

Figure 14:
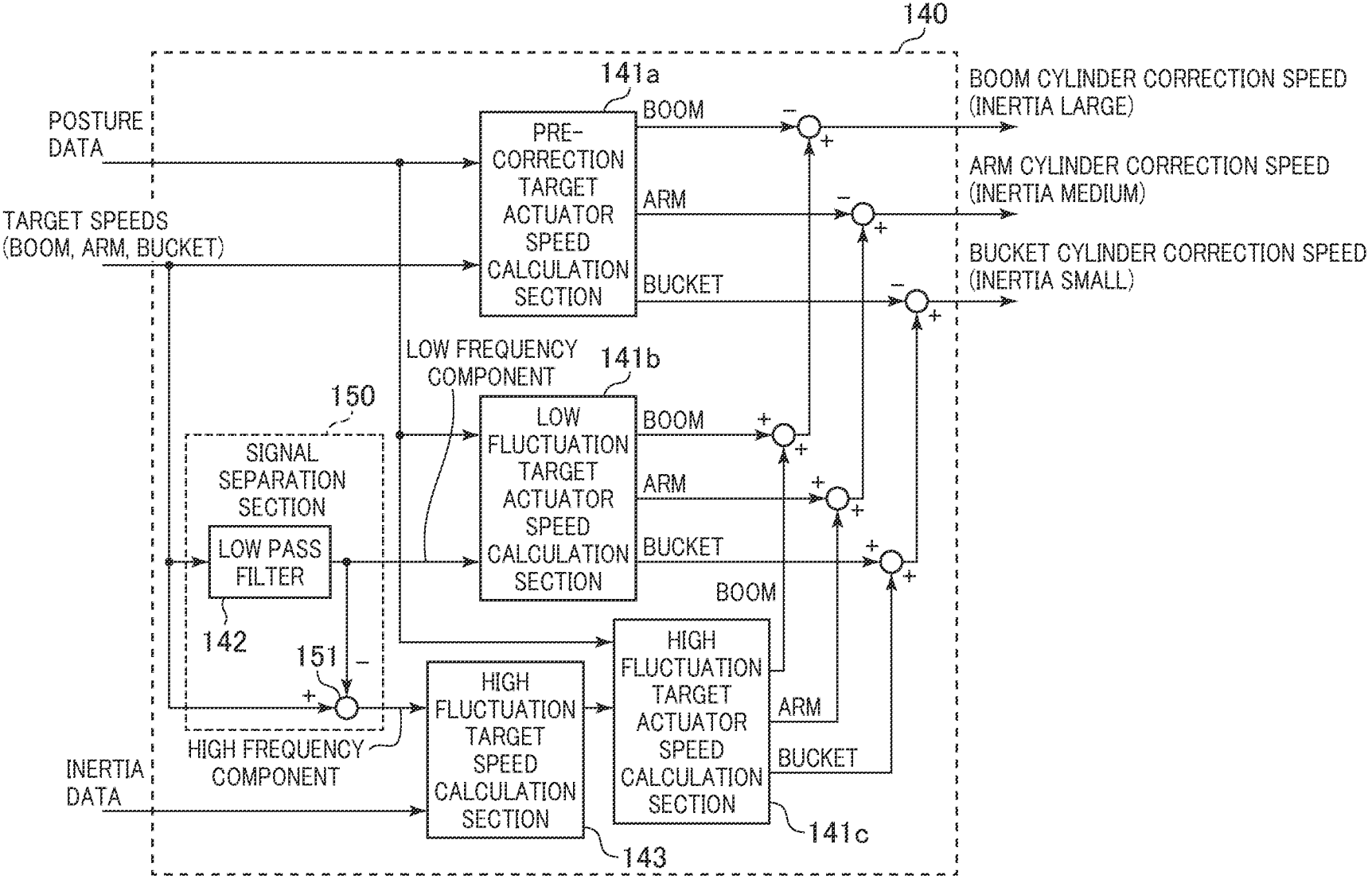
FIG. 14 is a functional block diagram of the correction speed calculation section 140 in a third embodiment.

FIG. 14 is a functional block diagram of the correction speed calculation section 140 in the third embodiment. The high fluctuation target speed calculation section 143 in the present embodiment allocates high frequency components separated by the signal separation section 150 preferentially to a front member whose inertial load is relatively small from among the three front members 8, 9 and 10 to calculate high fluctuation target speeds for the three front members 8, 9 and 10. In the present embodiment, the high frequency components of the target speed signals are distributed to the front members 8, 9 and 10 at a ratio determined taking the inertial loads of the front members 8, 9 and 10 into consideration. Since generally the inertial load of the boom 8, arm 9 and bucket 10 decreases in this order, from the point of view of the assurance of the responsiveness, it is preferable to increase the distribution rate in this order. For example, although the distribution ratio can be a ratio of reciprocals (namely, an inverse ratio), of numerical values obtained by quantifying the inertial loads of the boom 8, arm 9 and bucket 10 on the basis of the inertia data, some other ratio may be used. In addition, such a configuration that the distribution ratio is corrected in response to the posture data of the front members 8, 9 and 10 may be used.

As depicted in FIG. 14, in the present embodiment, outputs of the high fluctuation target actuator speed calculation section 141*c* are added to all of the three outputs from the low fluctuation target actuator speed calculation section 141*b*. In other words, all of the three outputs of the correction speed calculation section 140 are differences of the outputs of the pre-correction target actuator speed calculation section 141*a* from the sums of the outputs of the low fluctuation target actuator speed calculation section 141*b* and the outputs of the high fluctuation target actuator speed calculation section 141*c*.

According to the present embodiment configured in this manner, since the high fluctuation target actuator speed is distributed not only to the bucket 10 or the arm 9 but to the front members 8, 9 and 10 in accordance with a distribution ratio determined on the basis of inertia data, for example, in the case where the high fluctuation target speed is excessively high and exceeds a maximum action speed of the bucket 10, this can be coped with by allocating the remaining part of the high fluctuation target speed to the arm 9. Then, if the remaining part cannot be covered even if it is distributed to the bucket 10 and the arm 9, it is possible to cause to the boom 8 to bear part of the remaining part. This makes it possible to achieve stable semiautomatic excavation of high accuracy even in the case where the high fluctuation target speed is excessively high.

Fourth Embodiment

Figure 15:
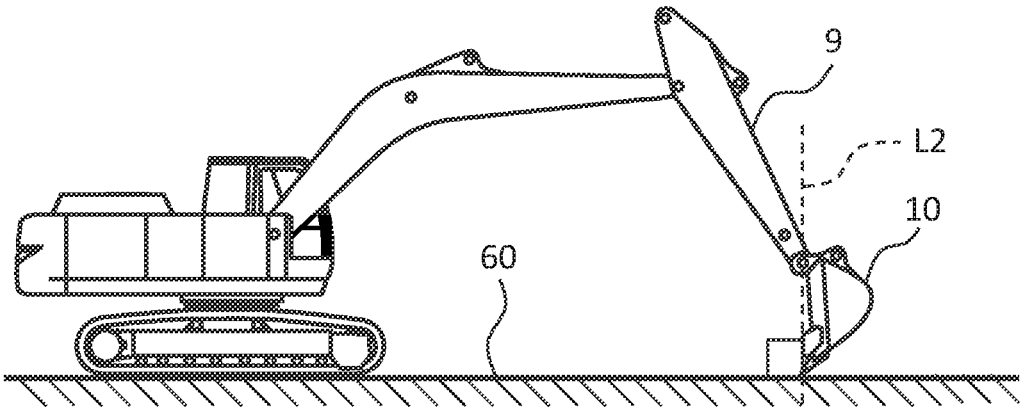
FIG. 15 is an explanatory view of a situation in which a bucket 10 takes a singular posture.
Figure 16:
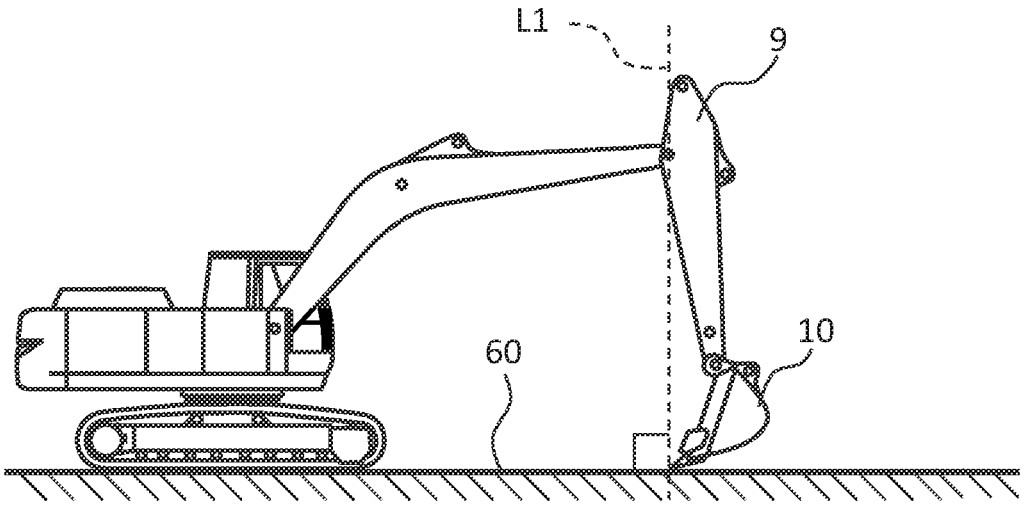
FIG. 16 is an explanatory view of a situation in which an arm 9 takes a singular posture.

There is the possibility that, from among the three front members 8, 9 and 10, the arm 9 or the bucket 10 may take such a posture that a straight line interconnecting the axis of pivotal motion of the same and the bucket distal end P4 is perpendicular to the target surface 60. (The posture just described is hereinafter referred to as "singular posture.") FIG. 15 is an explanatory view of a situation that the bucket 10 takes its singular posture, and FIG. 16 is an explanatory view of a situation that the arm 9 takes its singular posture. In the case where the arm 9 or the bucket 10 takes its singular posture, even if the hydraulic cylinder 12 or 13 for the arm 9 or the bucket 10 acts, a perpendicular speed component cannot be generated at the bucket distal end P4. If a high fluctuation speed is allocated to the front member 9 or 10 that is in such a situation as just described, then a command for an impossible action is provided to the hydraulic cylinder 12 or 13 and unstable action may be caused. Therefore, in the present embodiment, at least one of the arm 9 and the bucket 10 takes its singular posture, carrying out of the distribution of a target speed is aborted.

Figure 17:
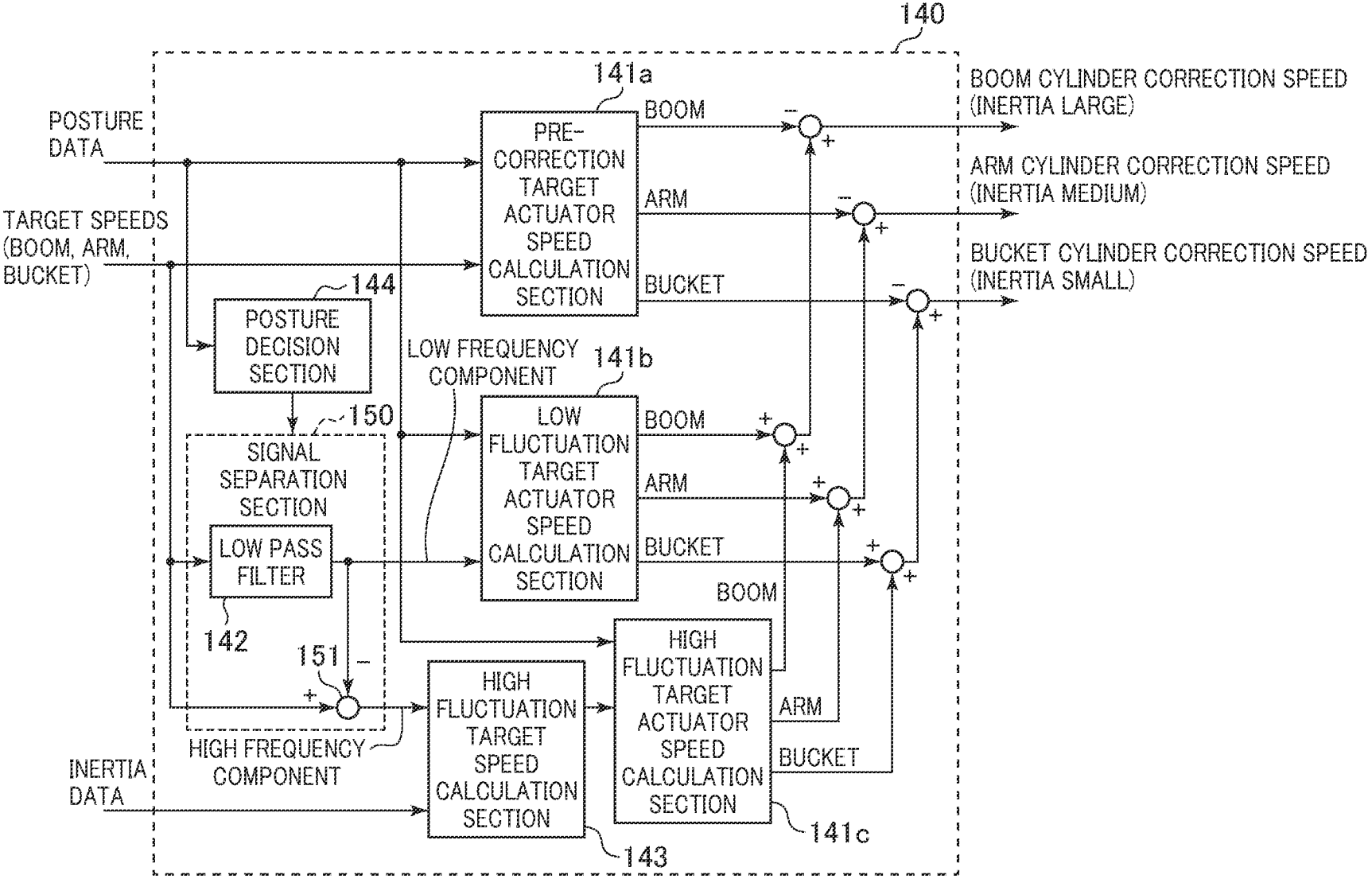
FIG. 17 is a functional block diagram of the correction speed calculation section 140 in a fourth embodiment.

FIG. 17 is a functional block diagram of the correction speed calculation section 140 in the fourth embodiment. The present embodiment is equivalent to the third embodiment in which a posture decision section 144 is additionally provided such that an output of the same is inputted to the low pass filter section 142.

The posture decision section 144 decides, on the basis of posture data of the work implement 7 and position data of the target surface, whether or not a first straight line L1 (depicted in FIG. 16) which interconnects the packet distal end and the center of pivotal motion of the arm 9 on an action plane of the work implement 7 is orthogonal to the target surface 60 and whether or not a second straight line L2 (depicted in FIG. 15) which interconnects the packet distal end and the center of pivotal motion of the bucket 10 is similarly orthogonal to the target surface 60 on the action plane of the work implement 7. Then, the posture decision section 144 outputs a result of the decision to the low pass filter section 142. In particular, in the case where the posture decision section 144 decides that one of the first straight line L1 and the second straight line L2 is orthogonal to the target surface 60, it outputs a reset signal.

In the case where it is decided by the posture decision section 144 that one of the first straight line L1 and the second straight line L2 is orthogonal to the target surface 60 (namely, in the case where a reset signal is outputted), the low pass filter section 142 (the signal separation section 150), does not execute the process for separating each of signals of target speeds for the three front members 8, 9 and 10 into a low frequency component having a frequency lower than the threshold value (shielding frequency) and a high frequency component having a frequency higher than the threshold value, but outputs the signals of the target speeds for the three front members 8, 9 and 10 as they are to the low fluctuation target actuator speed calculation section 141*b*. In particular, if a reset signal is inputted from the posture decision section 144, then the low pass filter section 142 temporarily stops its filter function and outputs the target speed signals for the front members 8, 9 and 10 inputted from the target speed calculation section 38 as they are.

If the correction speed calculation section 140 is configured in this manner, then in the case where one of the arm 9 and the bucket 10 takes its singular posture, the high frequency component outputted from the signal separation section 150 to the high fluctuation target speed calculation section 143 decreases zero without fail and the output of the pre-correction target actuator speed calculation section 141*a* and the output of the low fluctuation target actuator speed calculation section 141*b* coincide with each other without fail. As a result, all of the correction speeds outputted from the correction speed calculation section 140 are zero. In other words, conventional semiautomatic excavation control only with outputs of the actuator speed calculation section 130 is performed. Accordingly, according to the present embodiment, in the case where one of the arm 9 and the bucket 10 takes its singular posture, semiautomatic excavation control can be prevented from suffering from occurrence of unstable action.

Fifth Embodiment

Figure 18:
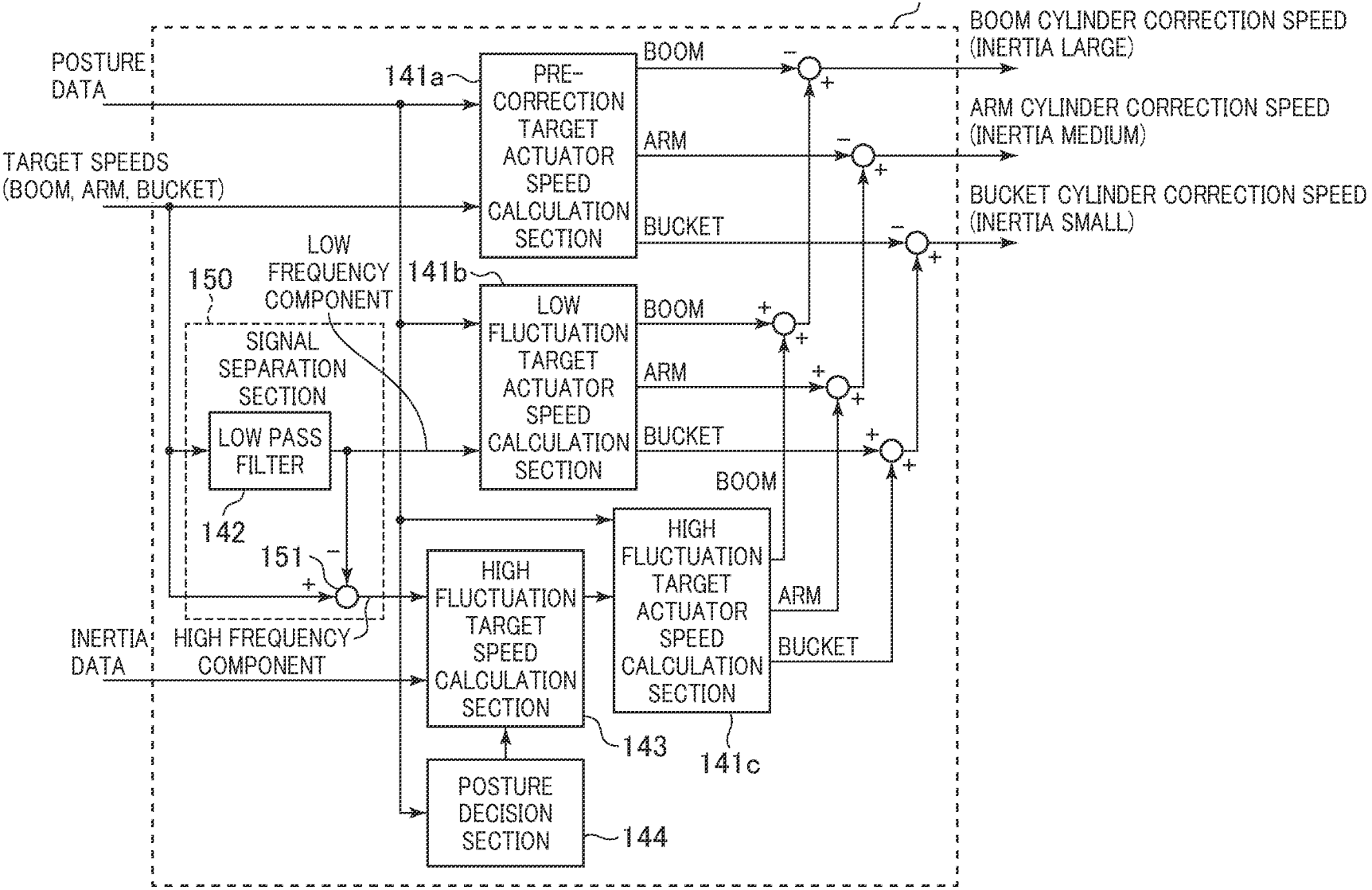
FIG. 18 is a functional block diagram of the correction speed calculation section 140 in a fifth embodiment.

FIG. 18 is a functional block diagram of the correction speed calculation section 140 in the fifth embodiment. The present embodiment is equivalent to the third embodiment in which the posture decision section 144 is additionally provided such that an outputs thereof is inputted to the high fluctuation target speed calculation section 143.

The posture decision section 144 performs decision same as that in the fourth embodiment and outputs a result of the decision to the low pass filter section 142. In particular, in the case where it is decided that one of the first straight line L1 and the second straight line L2 is orthogonal to the target surface 60, the posture decision section 144 outputs a reset signal. However, the reset signal in the present embodiment includes data indicating whether the front member that takes a singular posture is the arm 9 or the bucket 10.

In the case where it is decided by the posture decision section 144 that the first straight line L1 is orthogonal to the target surface 60, the high fluctuation target speed calculation section 143 distributes high frequency components of target speed signals for the boom 8, arm 9 and bucket 10 separated by the signal separation section 150 to the front members except the arm 9 from among the boom 8, arm 9 and bucket 10 (namely, to the boom 8 and the bucket 10), and calculates high fluctuation target speeds for the arm 9 and the bucket 10. On the other hand, in the case where it is decided by the posture decision section 144 that the second straight line L2 is orthogonal to the target surface 60, the high fluctuation target speed calculation section 143 distributes high frequency components of target speed signals for the boom 8, arm 9 and bucket 10 separated by the signal separation section 150 to the front members except the bucket 10 from among the boom 8, arm 9 and bucket 10 (namely, to the boom 8 and the arm 9), and calculates high fluctuation target speeds for the arm 9 and the bucket 10. However, in both cases, from a point of view of inertial loads, the distribution rate to the boom 8 may be set to zero. It is to be noted that, in the case where both of the first straight line L1 and the second straight line L2 are orthogonal to the target surface 60, the high frequency components are distributed only to the boom 8 to calculate a high fluctuation target speed.

If the correction speed calculation section 140 is configured in such a manner as described above, then in the case where the arm 9 or the bucket 10 takes its singular posture, the high fluctuation target speed for the front member that takes the singular posture becomes zero without fail, and the output of the pre-correction target actuator speed calculation section 141*a* and the output of the low fluctuation target actuator speed calculation section 141*b* coincide with each other without fail. As a result, the correction speed for the actuator of the front member outputted from the correction speed calculation section 140 becomes zero. In other words, for the front member that takes its singular posture, conventional semiautomatic excavation control with an output only of the actuator speed calculation section 130 is performed. Accordingly, according to the present embodiment, in the case where the arm 9 or the bucket 10 takes the singular posture, semiautomatic excavation control can be prevented from suffering from occurrence of unstable action. It is to be noted that, different from the fourth embodiment in which, in the case where a reset signal is outputted, the high fluctuation target actuator speeds for all front members are set to zero, in the present embodiment, a high fluctuation target actuator speed can be generated for any front member that does not take its singular posture. Therefore, semiautomatic excavation that is higher in accuracy than that in the fourth embodiment can be performed stably.

<Others>

The present invention is not limited to the embodiments described above and includes various modifications without departing from the subject matter of the same. For example, the present invention is not limited to configurations that include all components described in connection with the embodiments described above but includes configurations from which the components are partly omitted. Further, it is possible to add or replace part of the components of a certain embodiment to or with the components of a different embodiment.

Although, in the embodiments described hereinabove, the actuator speed calculation section 130 and the correction speed calculation section 140 are different calculation elements from each other, they may otherwise be integrated into a single calculation element having equivalent functions.

While, in the embodiments described hereinabove, the actuator speed calculation section 130 and the pre-correction target actuator speed calculation section 141*a* are provided, each of the target speeds for the actuators 11, 12 and 13 is the sum of a low fluctuation target actuator speed and a high fluctuation target actuator speed as demonstrated by procedure S12 of FIG. 12. Therefore, the controller 25 may be configured such that the actuator speed calculation section 130 and the pre-correction target actuator speed calculation section 141*a* are omitted and the sum of the output of the low fluctuation target actuator speed calculation section 141*b* and the output of the high fluctuation target actuator speed calculation section 141*c* is outputted as a target actuator speed to the actuator controller 200.

The components of the controller 25 and functions, execution processes and so forth of the components may be implemented partly or entirely by hardware such that (for example, logics that execute the functions are designed as an integrated circuit or circuits). Further, the components of the controller 25 described above may be given as a program (software) that implements the functions of the components of the controller 25 by being read out and executed by an arithmetic processing unit (for example, a CPU). Data relating to the program can be stored, for example, in a semiconductor memory (a flash memory or an SSD), a magnetic storage device (a hard disk drive), a recording medium (such as a magnetic disk or an optical disk) or the like.

DESCRIPTION OF REFERENCE CHARACTERS

1: Hydraulic excavator (work machine)
2: Track structure
3: Swing structure
4: Operation room
5: Machine room
6: Counterweight
7: Work implement
8: Boom
9: Arm
10: Bucket
11: Boom cylinder
12: Arm cylinder
13: Bucket cylinder
14: First hydraulic pump
15: Second hydraulic pump
16: Engine (prime mover)
17: Machine body tilt sensor
18: Boom tilt sensor
19: Arm tilt sensor
20: Bucket tilt sensor
21: First GNSS antenna
22: Second GNSS antenna
23: Machine body control system
24: Operation device
25: Controller
26: Flow control valve device
27: Hydraulic circuit
28: First arm spool (first flow control valve)
29: Second arm spool (third flow control valve)
30: Bucket spool
31: Boom spool (second flow control valve)
32*a*, 32*b*: First arm spool driving solenoid valve
33*a*, 33*b*: Second arm spool driving solenoid valve
34*a*, 34*b*: Bucket spool driving solenoid valve
35*a*, 35*b*: Boom spool driving solenoid valve
36*a*, 36*b*: Hydraulic working fluid tank
37: Distance calculation section
38: Target speed calculation section
41: Inertia information setting device
42: Second boom spool (fourth flow control valve)
43*a*, 43*b*: Second boom spool driving solenoid valve)
44: Hydraulic fluid tank
50: Work implement posture sensor
51: Target surface setting device
53: Control point position calculation section
54: Target surface storage section
60: Target surface
100: Target actuator speed calculation section
130: Actuator speed calculation section
140: Correction speed calculation section
141*a*: Pre-correction target actuator speed calculation section
141*b*: Low fluctuation target actuator speed calculation section
141*c*: High fluctuation target actuator speed calculation section
142: Low pass filter section
143: High fluctuation target speed calculation section
144: Posture decision section

15–: Signal separation section
151: Frequency component separation section
200: Actuator controller

The invention claimed is:

1. A work machine comprising:

a work implement having a plurality of front members;

a plurality of hydraulic actuators configured to drive the plurality of front members;

an operation device configured to instruct an action for each of the plurality of hydraulic actuators in response to an operation by an operator; and a controller including a target speed calculation section configured to calculate target speeds individually for the plurality of front members such that, when the operation device is operated, the work implement is limited so as to be positioned above a predetermined target surface; wherein the controller includes a signal separation section configured to separate each of signals of the target speeds for the plurality of front members into a low frequency component having a frequency lower than a predetermined threshold value and a high frequency component having a frequency higher than the threshold value;

a high fluctuation target speed calculation section configured to allocate the high frequency component separated by the signal separation section preferentially to one of the front members, the one front member having a relatively small inertial load, from among the plurality of front members to calculate high fluctuation target speeds individually for the plurality of front members;

a high fluctuation target actuator speed calculation section configured to calculate the high fluctuation target speeds individually for the plurality of actuators, based on the high fluctuation target speeds for the plurality of front members calculated by the high fluctuation target speed calculation section and posture data of the plurality of front members;

a low fluctuation target actuator speed calculation section configured to calculate low fluctuation target speeds individually for the plurality of actuators, based on the low frequency component separated by the signal separation section and the posture data of the plurality of front members; and an actuator controller configured to control the plurality of actuators individually, based on values obtained by adding results of the calculation of the high fluctuation target actuator speed calculation section and results of the calculation of the low fluctuation target actuator speed calculation section individually for the plurality of actuators.

2. The work machine according to claim 1, wherein the work implement includes a boom, an arm and a work tool; and the high fluctuation target speed calculation section allocates high frequency components of target speeds for the boom, the arm and the work tool separated by the signal separation section only to the work tool to calculate high fluctuation target speeds for the boom, the arm and the work tool.

3. The work machine according to claim 1, wherein the work implement includes a boom, an arm and a work tool; and the high fluctuation target speed calculation section allocates high frequency components of target speeds for the boom, the arm and the work tool separated by the signal separation section only to the arm to calculate high fluctuation target speeds for the boom, the arm and the work tool.

4. The work machine according to claim 1, wherein the work implement includes a boom, an arm and a work tool; and the controller further includes a posture decision section configured to decide, based on posture data of the work implement, whether or not a first straight line interconnecting a distal end of the work tool and a center of pivotal motion of the arm is orthogonal to a target surface on an action plane of the work implement and whether or not a second straight line interconnecting the distal end of the work tool and a center of pivotal motion of the work tool is orthogonal to the target surface on the action plane of the work implement; and the signal separation section does not execute, where it is decided by the posture decision section that either one of the first straight line or the second straight line is orthogonal to the target surface, a process for separating each of the signals of the target speeds for the plurality of front members into a low frequency component having a frequency lower than the threshold value and a high frequency component having a frequency higher than the threshold value and outputs the signals of the target speeds for the plurality of front members as they are to the low fluctuation target actuator speed calculation section.

5. The work machine according to claim 1, wherein the work implement includes a boom, an arm and a work tool;

the controller further includes a posture decision section configured to decide, based on posture data of the work implement, whether or not a first straight line interconnecting a distal end of the work tool and a center of pivotal motion of the arm is orthogonal to a target surface on an action plane of the work implement and whether or not a second straight line interconnecting the distal end of the work tool and a center of pivotal motion of the work tool is orthogonal to the target surface on the action plane of the work implement; and the high fluctuation target speed calculation section distributes, where it is decided by the posture decision section that the first straight line is orthogonal to the target surface, high frequency components of target speeds for the boom, the arm and the work tool separated by the signal separation section to front members except the arm from among the plurality of front members to calculate the high fluctuation target speeds individually for the boom, the arm and the work tool, and distributes, where it is decided by the posture decision section that the second straight line is orthogonal to the target surface, high frequency components of target speeds for the boom, the arm and the work tool separated by the signal separation section to front members except the work tool from among the plurality of front members to calculate the high fluctuation target speeds individually for the boom, the arm and the work tool.

6. The work machine according to claim 1, wherein the high fluctuation target speed calculation section calculates a total of components perpendicular to the target surface from within the high frequency components separated by the signal separation section and distributes the total preferentially to one of the front members, the one front member having a relatively small inertial load, from among the plurality of front members to calculate the high fluctuation target speeds individually for the plurality of front members.

* * * * *